US009198521B2

(12) United States Patent
Robertson

(10) Patent No.: US 9,198,521 B2
(45) Date of Patent: Dec. 1, 2015

(54) ADJUSTABLE FURNITURE

(71) Applicant: INTEGRATED FURNITURE TECHNOLOGIES LIMITED, Forthampton Gloucestershire (GB)

(72) Inventor: Dale Robertson, Cheltenham (GB)

(73) Assignee: INTEGRATED FURNITURE TECHNOLOGIES LIMITED, Gloucestershire (GB)

( * ) Notice: Subject to any disclaimer, the term of this patent is extended or adjusted under 35 U.S.C. 154(b) by 0 days.

(21) Appl. No.: 14/554,114

(22) Filed: Nov. 26, 2014

(65) Prior Publication Data

US 2015/0074909 A1 Mar. 19, 2015

Related U.S. Application Data

(62) Division of application No. 13/502,561, filed as application No. PCT/GB2011/001961 on Oct. 22, 2010, now Pat. No. 8,955,178.

(30) Foreign Application Priority Data

Oct. 23, 2009 (GB) ..... 0918685.9
Aug. 18, 2010 (GB) ..... 1013879.0

(51) Int. Cl.
*A47C 20/08* (2006.01)
*A61G 7/015* (2006.01)
(Continued)

(52) U.S. Cl.
CPC ..... *A47C 20/08* (2013.01); *A47C 20/041* (2013.01); *A61G 7/015* (2013.01); *A61G 7/018* (2013.01)

(58) Field of Classification Search
CPC ..... A61G 7/015; A61G 7/018; A47C 20/041; A47C 20/08
USPC ..... 5/613, 617, 618
See application file for complete search history.

(56) References Cited

U.S. PATENT DOCUMENTS 349,089 A 9/1886 Gilbert
638,466 A 12/1899 Kelly
(Continued)

FOREIGN PATENT DOCUMENTS

DE 297 15 343 11/1997
DE 029715343 1/1998
(Continued)

OTHER PUBLICATIONS

PCT/GB2010/001565 International Search Report mailed Apr. 12, 2011, 6 pages—English.
(Continued)

*Primary Examiner* — Michael Trettel
(74) *Attorney, Agent, or Firm* — Andrew F. Young, Esq.; Lackenbach Siegel, LLP

(57) ABSTRACT

A novel article of adjustable bed is disclosed. The adjustable bed comprises at least two body-support portions and a base support for supporting the body support portions. The body support portions are mounted with respect to the base to allow angular adjustment of their relative positions to alter the configuration of the bed. Actuators are provided for angularly moving one or more of the body-support portions to effect angular adjustment of the bed. A load-bearing member projects from one of the moveable body-support portios and is supported by a bearing means arranged to run on a curved support such that each moveable body-support portion is pivotally mounted with respect to the base about a respective pivot axis defined by the center of curvature of the respective curved support. The pivot axis of the movable body-support portion is positioned above the base in a plane offset from the top edge thereof.

24 Claims, 21 Drawing Sheets

(51) Int. Cl.
*A47C 20/04* (2006.01)
*A61G 7/018* (2006.01)

(56) References Cited

U.S. PATENT DOCUMENTS

| | | | | | |
|---|---|---|---|---|---|
| 912,214 | A | | 2/1909 | Ward | |
| 942,354 | A | * | 12/1909 | Ryan | 5/634 |
| 1,238,078 | A | | 8/1917 | Ault | |
| 1,414,637 | A | | 5/1922 | Gell | |
| 2,954,072 | A | | 9/1960 | Fossati | |
| 3,086,814 | A | | 4/1963 | Fletcher | |
| 3,121,589 | A | | 2/1964 | Schliephacke | |
| 3,202,453 | A | | 8/1965 | Richards | |
| 3,269,767 | A | | 8/1966 | Marzocchi | |
| 3,873,152 | A | | 3/1975 | Garas | |
| 4,371,996 | A | * | 2/1983 | Nahum | 5/618 |
| 4,406,027 | A | * | 9/1983 | Bourda | 5/17 |
| 4,547,017 | A | | 10/1985 | Lescure | |
| 4,635,999 | A | | 1/1987 | Simpson | |
| 4,774,732 | A | * | 10/1988 | Riedl | 5/613 |
| 5,112,109 | A | | 5/1992 | Takada et al. | |
| 5,246,266 | A | | 9/1993 | Ostergaard | |
| 5,261,725 | A | * | 11/1993 | Rudolph | 297/361.1 |
| 5,577,279 | A | | 11/1996 | Foster et al. | |
| 5,785,384 | A | | 7/1998 | Sagstuen | |
| 5,897,462 | A | | 4/1999 | St. Germain | |
| 6,059,364 | A | | 5/2000 | Dryburgh et al. | |
| 6,101,647 | A | | 8/2000 | Stroud et al. | |
| 6,393,641 | B1 | | 5/2002 | Hensley | |
| 6,499,162 | B1 | | 12/2002 | Lu | |
| 6,568,755 | B1 | | 5/2003 | Groening | |
| 6,640,365 | B1 | | 11/2003 | Chang | |
| 6,641,214 | B2 | | 11/2003 | Veneruso | |
| 6,739,661 | B1 | | 5/2004 | Dukes | |
| 6,857,148 | B2 | * | 2/2005 | Van Raemdonck | 5/617 |
| 7,219,958 | B2 | | 5/2007 | Yamazaki et al. | |
| 7,390,060 | B2 | | 6/2008 | Kristen | |
| 7,445,279 | B2 | | 11/2008 | Crum | |
| 7,698,761 | B2 | | 4/2010 | Neuenswander et al. | |
| 7,703,851 | B2 | | 4/2010 | Nakaya et al. | |
| 7,997,654 | B2 | | 8/2011 | Ferry et al. | |
| 8,303,036 | B2 | | 11/2012 | Hankinson et al. | |
| 8,403,415 | B2 | | 3/2013 | Lawson | |
| 8,424,964 | B2 | | 4/2013 | Campbell et al. | |
| 8,534,758 | B2 | | 9/2013 | Rivera | |
| 8,931,126 | B1 | * | 1/2015 | Xu | 5/616 |
| 8,955,178 | B2 | * | 2/2015 | Robertson | 5/613 |
| 2002/0053109 | A1 | | 5/2002 | Elliott | |
| 2002/0060483 | A1 | | 5/2002 | Yoshida et al. | |
| 2002/0174487 | A1 | | 11/2002 | Kramer et al. | |
| 2003/0172455 | A1 | | 9/2003 | Roma et al. | |
| 2004/0155504 | A1 | | 8/2004 | Tada | |
| 2007/0120409 | A1 | | 5/2007 | Leeds | |
| 2007/0158980 | A1 | | 7/2007 | LaPointe et al. | |
| 2008/0150329 | A1 | | 6/2008 | Lawson | |
| 2008/0276373 | A1 | | 11/2008 | Clenet | |

FOREIGN PATENT DOCUMENTS

| | | |
|---|---|---|
| DE | 010152227 | 5/2003 |
| DE | 10 2007 024 218 | 11/2008 |
| DE | 10 2007 024218 | 11/2008 |
| DE | 102007024218 | 11/2008 |
| EP | 0781518 | 12/1996 |
| EP | 0865960 | 3/1998 |
| EP | 0865960 | 9/1998 |
| EP | 0 891 730 | 1/1999 |
| EP | 1197170 | 4/2002 |
| EP | 1 621 173 | 2/2006 |
| GB | 0101239 | 8/1916 |
| GB | 0329834 | 5/1930 |
| GB | 0414464 | 8/1934 |
| GB | 0775679 | 5/1957 |
| GB | 1075154 | 7/1967 |
| GB | 2227932 | 8/1990 |
| GB | 2474947 | 10/2010 |
| GB | 2499928 | 2/2014 |
| GB | 191322022 | 8/2014 |
| JP | 36-13946 | 5/1936 |
| JP | 61 181562 | 11/1986 |
| JP | 08-173263 | 7/1996 |
| JP | 08-308680 | 11/1996 |
| JP | 11-244096 | 9/1999 |
| JP | 2003-144262 | 5/2003 |
| JP | 2003310666 | 11/2003 |
| WO | WO 2006/023447 | 3/2006 |
| WO | WO/2011/021002 | 2/2011 |
| WO | WO 2011/048384 | 4/2011 |

OTHER PUBLICATIONS

U.S. Appl. No. 13/380,985, filed Feb. 2012, Robertson.
International Search Report for PCT/GB2010/001565 dated May 26, 2011, 6 pages.
Combined Search and Examination report for GB 1013879.0, dated Dec. 7, 2010 (6 pages).
International Search Report for PCT/GB2010/001961 dated Nov. 2, 2011, 2 pages.
Search Report for GB1017996.8 dated Feb. 24, 2011, 2 pages.
U.S. Appl. No. 13/390,985, filed Feb. 17, 2012, Office Action mailed Jan. 7, 2015, 20 pages.

* cited by examiner

ADJUSTABLE FURNITURE

CROSS REFERENCE TO RELATED APPLICATIONS

This application relates to and is a divisional of, and claims priority from U.S. application Ser. No. 13/502,561 filed Apr. 18, 2012, now U.S. Pat. No. 8,955,178, which in turn claims priority to PCT Application Serial No. PCT/GB2010/001961 filed Oct. 22, 2010 and GB Application Serial No. 1013879.0 filed Aug. 18, 2010, and GB Serial No. 0918685.9 filed Oct. 23, 2009, the entire contents of which are herein incorporated by reference.

FIGURE SELECTED FOR PUBLICATION

FIG. 5

BACKGROUND OF THE INVENTION

1. Field of the Invention

This invention relates to adjustable furniture and in particular concerns adjustable beds having adjustable body-support sections which can be moved to adjust the position of a user.

2. Description of the Related Art

Adjustable beds are known for example from US2009/0193587 which discloses an adjustable bed in which a back/head support section and leg/foot support sections are pivotably mounted next to a fixed intermediate support section. Electrical linear actuators are attached to the underside of both the back and leg support sections for moving those sections between horizontal and inclined positions. The linear actuators act more-or-less directly on the underside of the moveable body support portions. Each of the body support sections is provided with a flexible cushion and in order to prevent crushing of the adjacent ends of the respective cushions, during adjustment of the bed, the bed includes independently moveable front and rear carriages powered by linear actuators supported on a stationary base. The back/head support section is pivotally secured to one carriage and moves linearly with it. The leg and foot support sections are pivotally connected together and are supported by the other carriage and move with it. This arrangement prevents crushing of the respective cushions and adjacent parts of a support mattress supported on the cushions in use, that is when the bed is raised from the lying flat position to its raised position.

The adjustable bed disclosed in US2009/0193587 provides a solution to the problem of compression of the adjoining edges of the adjacent body support cushions due to compression points being developed when the respective sections of the bed are moved to their raised positions. This arrangement requires a minimum of four linear actuators, one each for moving the pivotable parts of the bed and one for each moveable carriage. The moveable front and rear carriages and associated actuators adds considerable cost and weight to the adjustable bed. This and other known adjustable bed arrangements are mechanically complex and expensive to manufacture. There is a requirement therefore for a lighter and less expensive adjustment mechanism for articles of adjustable furniture having sufficient strength, weight carrying capacity and durability.

ASPECTS AND SUMMARY OF THE INVENTION

According to an aspect of the present invention there is provided an article of adjustable furniture such as an adjustable bed, said article of furniture comprising at least two body-support sections, a base support for supporting said body support portions, the said body support portions being mounted with respect to the base to allow angular adjustment of their relative positions to alter the configuration of the said article of furniture, and actuator means for angularly moving one or more of the body-support portions to effect the said angular adjustment, characterised in that at least one load-bearing member projects from at least one of moveable body-support portion(s), the said load-bearing member being supported by bearing means arranged to run on a curved support such that the or each moveable body-support portion is pivotally mounted with respect to the said base about a respective pivot axis defined by the centre of curvature of the respective curved support(s).

The above aspect of the invention readily enables the weight of the user to be supported by the article of furniture with the load bearing structure of the furniture being integrated in such a way that the weight carried by the furniture is readily transferred to the base. The arrangement of the load bearing member(s), bearing means and curved support readily enables the body-support portions to be moved, independently if necessary, about their respective pivot axis which may be offset from the base and positioned appropriately to avoid compression of adjacent soft cushion parts carried by the body support sections.

In preferred embodiments the pivot axis of the or each movable body-support portion is positioned above the said base in a plane offset from the top edge thereof. Preferably the pivot axis or axes is/are positioned in a plane offset from the base by an amount substantially corresponding to the thickness of the body support portions such that the offset plane is substantially coincident with an upper support surface of the body support portions when in a flat horizontal position. The offset nature of the pivot axis or axes can substantially eliminate interference of the respective body support portions when they move with respect to one another as the pivot axis may be positioned at a common hinge position between adjacent body support portions. In preferred arrangements where the body support portions include a compressible cushion or other compressible support means interference at the respective adjacent ends can be readily avoided.

In preferred embodiments, the load bearing member comprises at least one plate-like projection from the underside of the relevant body-support portion. The invention also contemplates alternative structures, for example struts or tubular frames, which could be used as the load bearing members(s). The base may comprise a support frame of any suitable material including metal, engineering plastic or suitable board material, for example timber, MDF or other suitable fibre board. The base is preferably arranged as a divan type base structure, that is to say a rectangular box-type structure in which a pair of lateral side panels are joined at their respective ends by a respective end panel to close the structure to create a divan type load bearing frame.

In preferred embodiments the bearing means is carried by the load bearing member. Preferably, the curved support is provided on or in the base, preferably in a slot in the base. Preferred embodiments of the invention therefore contemplate arrangements where one or more curved slots are provided in the base, preferably the lateral side panels thereof, to receive respective bearing means for supporting and guiding the body support portions with respect to the base.

In preferred embodiments at least one pair of load bearing members project from each moveable body support portion. Preferably each pair of load bearing members are spaced apart towards the respective sides of the base. In preferred embodiments the pair of load bearing members lie substantially parallel with respective lateral side panels of the base. This arrangement readily provides for a compact arrangement in which the load bearing members are positioned closely adjacent to the respective lateral side panels away from other moving parts of the furniture, including the actuator means which may preferably be located within the structure of the base.

The bearing means carried by the load bearing member may be of any appropriate kind, for example roller bearings mounted on a shaft. In preferred embodiments, the bearing means is carried by the said load bearing member and the curved track is provided on or in the base. It is however possible to use a reverse arrangement in which the bearing means is carried on the base and runs in a track in or on the load bearing projection.

In preferred embodiments the load bearing members lie substantially parallel with respective lateral side panels of the base.

Each pair of load bearing members may be connected together by a respective cross member, in addition to the respective body support portion, with the cross member preferably extending on the underside of the body support portion. Such a cross member will have the effect of stiffening the moveable structure and also provide an attachment point for connection to a powered actuator.

In preferred arrangements the or each curved support is provided on or in a respective side panel of the base.

In preferred embodiments the or each moveable body support portion is pivotably mounted with respect to the base about a respective pivot axis defined by the centre of curvature of the respective curved support(s). In this way it is possible to define the position of the pivot axis at any appropriate position within the article of furniture.

In preferred embodiments the load bearing member comprises at least one substantially semi-circular planar element, or part thereof, positioned on the underside of the body support portion. In this way the respective load bearing members may lie within the space envelope, or depth dimension, of the base when the respective body support portions lie flat in their lowered position. In this way the load bearing members may be wholly contained within the base when the respective body support portions are lowered, or at least with no part of the respective load bearing members protruding above, or below, the lateral sides of the base.

In preferred embodiments the actuator means is arranged to apply the adjustment force substantially to the underside of the moveable body support portion to which it is attached. In this way the actuator loads may be minimised by increasing the perpendicular distance between the pivot axis of the respective body support portion and the point of application of the actuator load.

In preferred embodiments the actuator means comprises of at least one electric motor driving an extended threaded spindle. In preferred embodiments, actuator means, preferably a single actuator, is associated with each of the relatively moveable body support portions so that each may be operated independently.

In preferred embodiments the body support portion comprises at least a seat support and an adjustable back support having the said load bearing member or members projecting from the back support.

The body support portion may comprise a leg and foot support having the load bearing member projecting from the leg support. In preferred embodiments the leg support includes an adjustable foot and calf support pivotably attached to the main part of the leg support. Preferably the foot/calf support is arranged to pivot apart from the leg support during angular adjustment of the leg support, and the load bearing member projecting from the leg support provides a stop that stops the pivoting of the foot support at a predetermined angle relative to the leg support. In this way the raised configuration of the leg support is determined by the position of the stop, the position being predetermined by human anatomical considerations thereby to provide for maximum comfort of the user.

In preferred embodiments the article of furniture is an adjustable bed, adjustable between a sitting position and a lying position, the bed having a seat portion fixed with respect to the base, an adjustable back portion on one side of the seat portion and an adjustable leg support and foot/calf support on the other side of the fixed seat portion.

The above and other aspects, features and advantages of the present invention will become apparent from the following description read in conjunction with the accompanying drawings, in which like reference numerals designate the same elements.

BRIEF DESCRIPTION OF THE DRAWINGS

The various embodiments of the present invention will now be more particularly described, by way of example only, with reference to the accompanying drawings; in which.

DETAILED DESCRIPTION OF THE PREFERRED EMBODIMENTS

Figure 1:
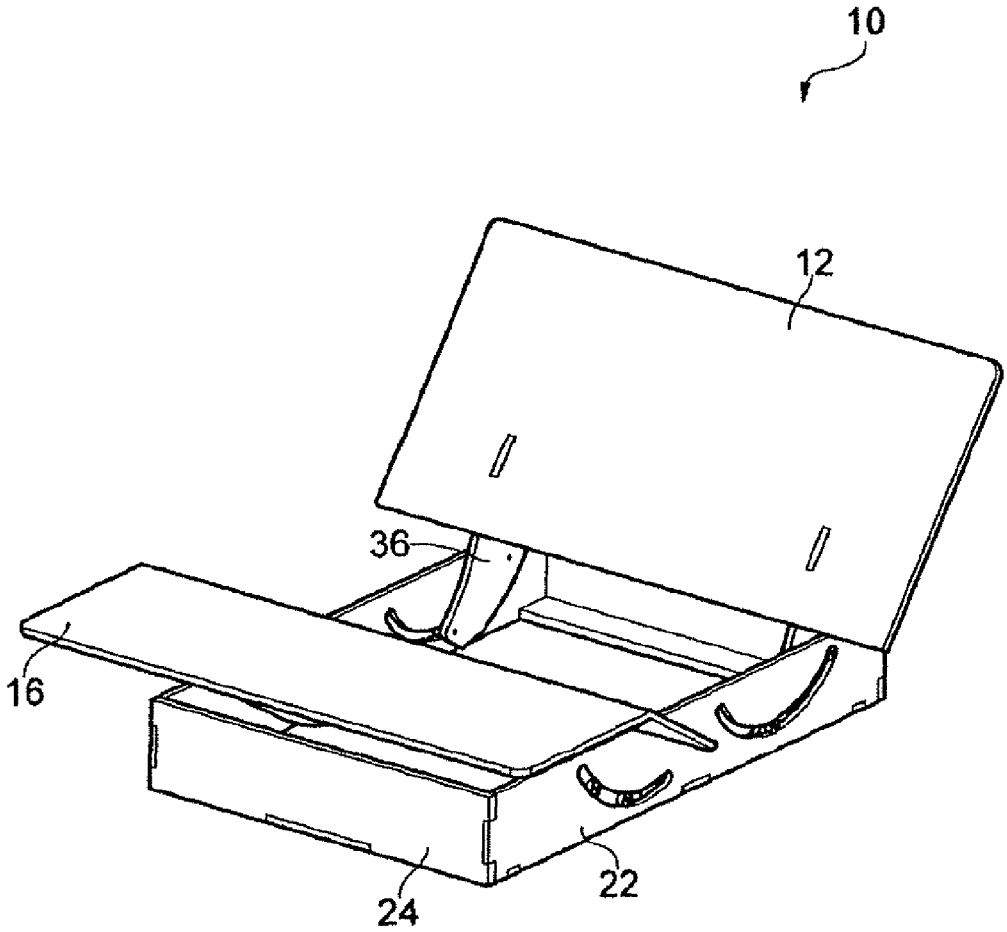
FIG. 1 is a perspective view from the front of an adjustable bed according to an embodiment of the invention.
Figure 2:
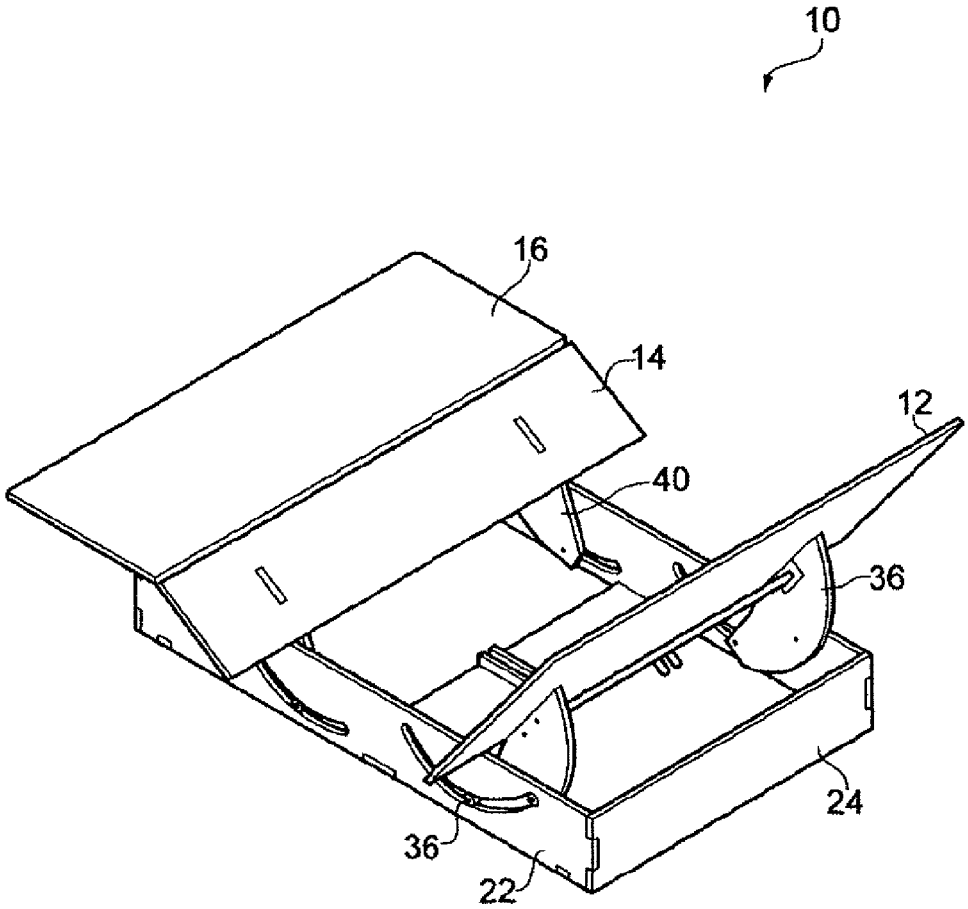
FIG. 2 is a perspective view from the rear of the bed of FIG. 1.
Figure 3:
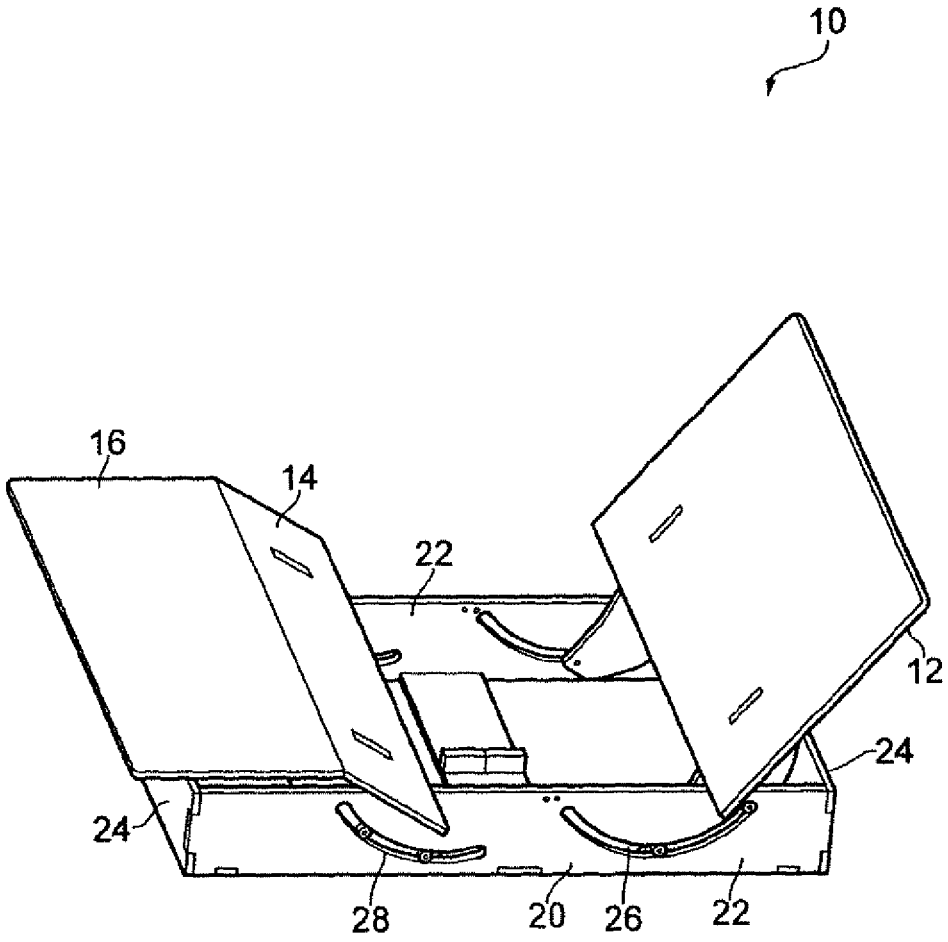
FIG. 3 is a perspective view from the side of the bed of FIGS. 1 and 2.

R Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Referring to the drawings, FIGS. 1 to 6 schematically show an adjustable bed 10 according to a first embodiment of the present invention. The bed 10 comprises a back/head support panel 12, an upper leg support panel 14 and a foot and lower leg support panel 16. The panels 12, 14 and 16 are each adjustably mounted on a plinth type support frame or base 20. In FIGS. 1 to 6 the bed 10 is shown in an upright configuration with the panels 12, 14 and 16 inclined with respect to the base to support the user in a raised seated position. In their lowered position the panels lie substantially flat on top of the base 20 to support the user horizontally in a lying down position. In the lowered position the body support panels 12 14 and 16 combine with an intermediate support panel (not shown). The intermediate panel is fixed in relation to the base between the back support panel 12 and the upper leg support panel 14 to define a substantially flat horizontal platform. The various body support panels each support a mattress support cushion (not shown) which cushions combine to provide a mattress foundation for supporting a mattress, as is well known to those skilled in the art of adjustable beds.

Figure 4:
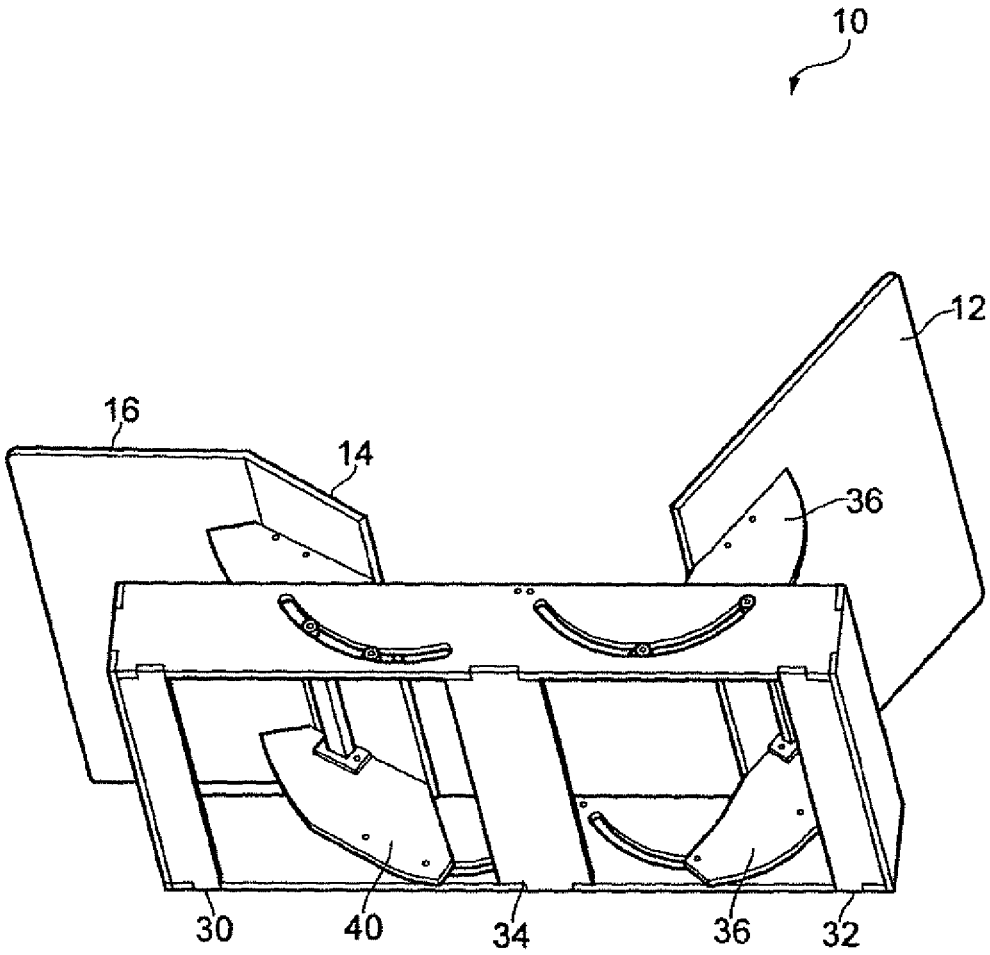
FIG. 4 is a perspective view of the bed of FIGS. 1 to 3 from below.
Figure 5:
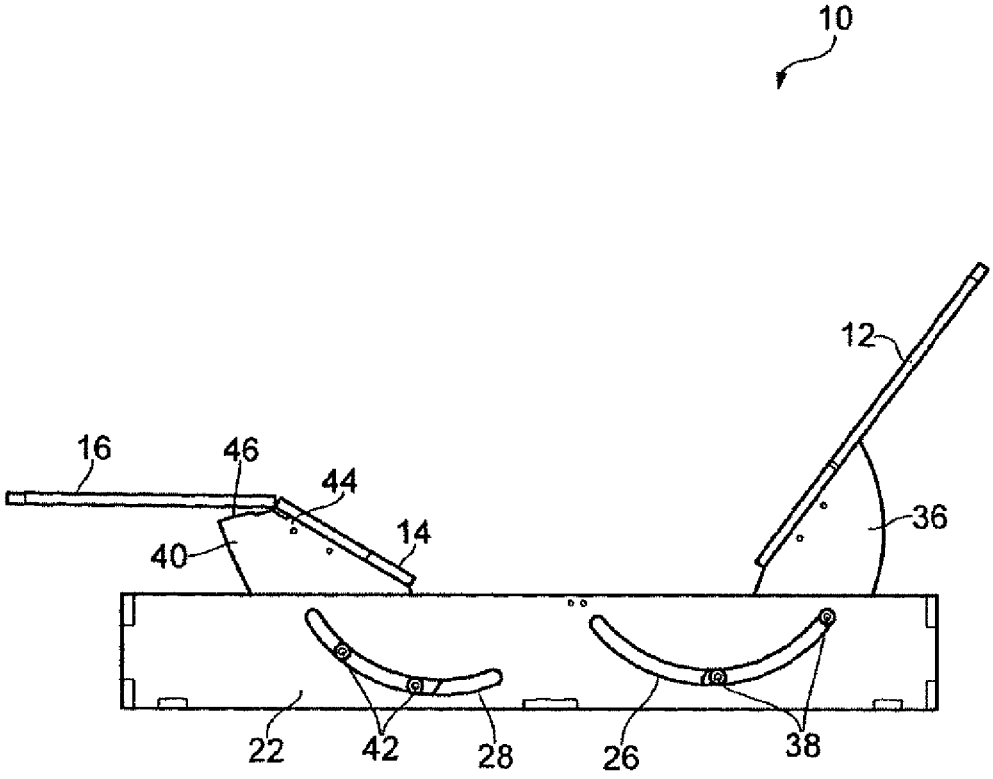
FIG. 5 is a side elevation view of the bed of FIGS. 1 to 4.

The base 20 comprises a generally rectangular frame constructed from a board type material, for example an engineering plastic, wood, MDF or other fibreboard material. The frame 20 includes a pair of elongate lateral side panels 22 which are joined together at the respective ends by end panels 24 to form a rectangular box type structural load bearing frame. The side panels 22 are substantially identical, each having a pair of curved guide slots 26, 28 for accommodating respective support bearings 38, 42 as will be more fully described below. A first guide slot 26 is provided in the rearward half of the panel 22 and a second slot 28 in the forward half of the panel. The frame of the base is reinforced by respective front, rear and central cross-members 30, 32, and 34 extending on the underside of the base between the respective side panels 22 as best seen in FIG. 4.

The back support panel 12 is pivotally mounted to the base by a pair of load bearing support members 36 attached to and extending from the underside of the support panel 12. The load bearing support members 36 are spaced apart and located on opposite sides of the panel 12 so that they lie substantially adjacent to the respective side panels 22 of the base on the inner side thereof such that roller bearings 38 rotatably mounted on the sides of the load bearing members 36 locate, and are held captive in, the respective slots 26. As can best be seen in the drawing of FIG. 5 each load bearing member 36 is provided with a pair of roller bearings 38 spaced apart by a distance corresponding to approximately half the length of the curved slot 26. In this way the ends of the slot define the range of pivotal movement of the support panel 12 about its pivot axis, as defined by the centre of curvature of the slot, by abutment of one of the bearings 38 with a respective end of the slot.

The load bearing members 36 are substantially semi circular in shape and are designed such that they lie substantially flush against the respective side panels 22, within the envelope of the base frame. When occupying their lowered position (not shown) the panel 12 lies substantially flat on or just above the top edge of the frame 20.

The roller bearings 38 are preferably mounted on shafts extending from the load bearing members 36 so that they are free to rotate and thereby move freely within the respective slots 26.

The upper leg support panel 14 at the forward end of the bed is similarly pivotally connected to the frame by means of a pair of load bearing members 40 and associated roller bearings 42 positioned in the forward slots 28. The upper leg support panel 14 is fixed to an upper edge 44 of the load bearing members 40. The lower leg/foot support panel 16 is hinged to the panel 14 along their respective adjoining edges.

The curved slots 26 and 28 are generally arcuate having a centre of curvature located above the upper surface of the base support frame 20. In preferred embodiments the centres of curvature of the slots 26 and 28 are positioned at a predetermined distance above the top edge of the frame and the respective support panels 12, 14, 16 when the panels are positioned horizontal. This pre-determined distance preferably corresponds to the thickness or so of the aforementioned mattress foundations cushions positioned on top of the panels in use, with the centre of curvature of each slot being positioned between the adjacent top edges of the support cushions to prevent crushing thereof. This arrangement is more fully described in relation to the second and third embodiments below.

The length of the respective slots 26, 28 is sufficient to accommodate the angular movement of the respective panels between their raised and lowered positions.

The load bearing member 40 is attached to the underside of the upper leg support panel 14. The leg support load bearing member 40 has an angled surface 46 which acts as a mechanical stop so that the upper leg support and the lower leg/foot support panels 14 and 16 are retained at a pre-determined angle with respect to each other when the panels are raised due to contact of the underside of the panel 16 with the angled surface 46.

Figure 6:
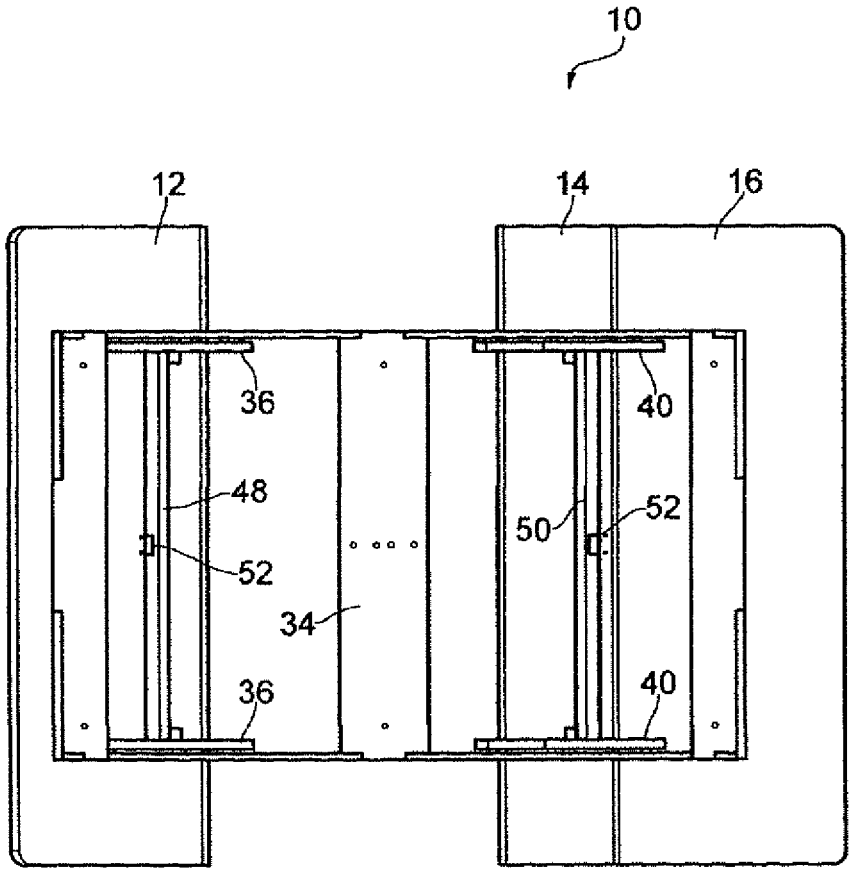
FIG. 6 is a plan view from below the bed of FIGS. 1 to 5.

As can be best seen in the plan view from below in FIG. 6 the respective load bearing members 36 of the back support and the load bearing members 40 of the leg support panels are joined together not only by the respective support panels 12 and 14, but also by respective cross members 48 and 50, which maybe provided by appropriate metal beam sections, having attachment brackets 52 for connection to one end of an actuator, for example an electric linear actuator, the other end of which maybe mounted on the cross member 34 of the base 20. Thus, it will be understood that movement of the adjustable body support portions may be effected by extension of the respective actuators to cause movement of the load bearing members 36 and 40 about their respective pivot axis at the centre of curvature of the respective slots. It will be understood that significant turning moment may be generated from such linear actuators due to their relative positioning in relation to the respective slots 26 and 28 and the pivot axes of the panels defines by the slots, that is to say the force vector of each actuator is offset significantly, perpendicularly, from the pivot axis of the respective support panel which it moves.

Figure 7:
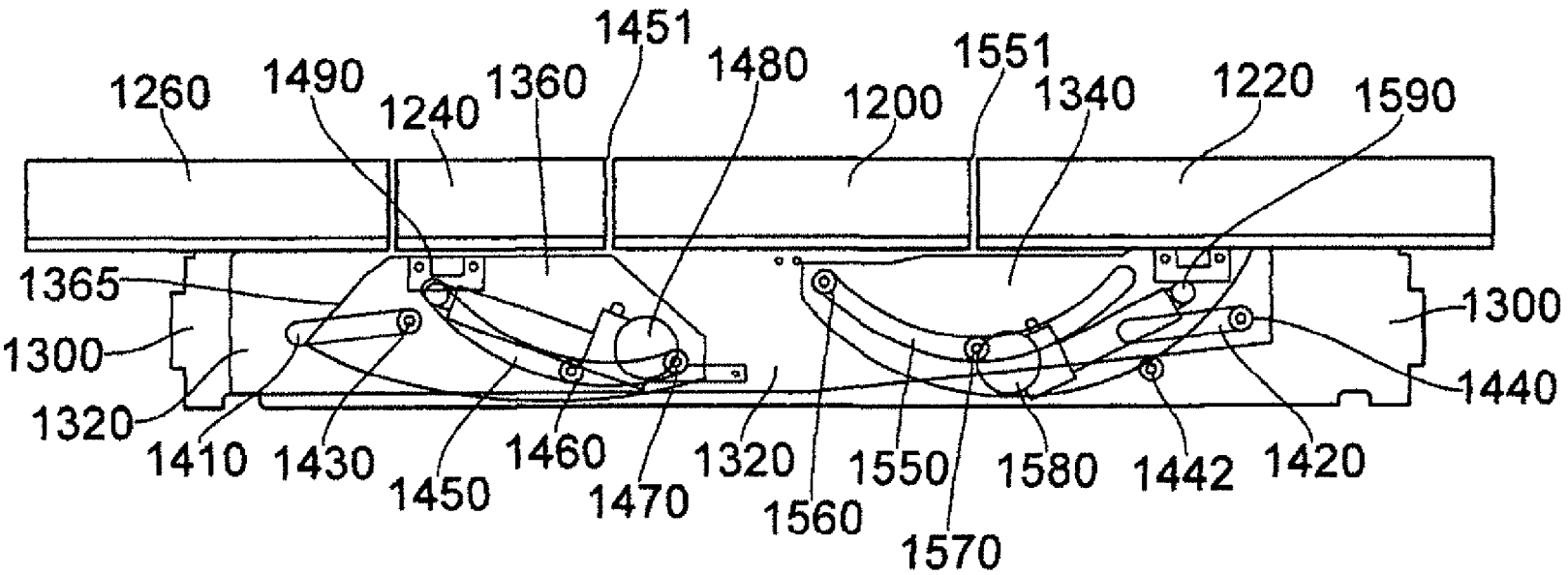
FIG. 7 shows an adjustable bed according to another embodiment of the invention in a user lying position.
Figure 8:
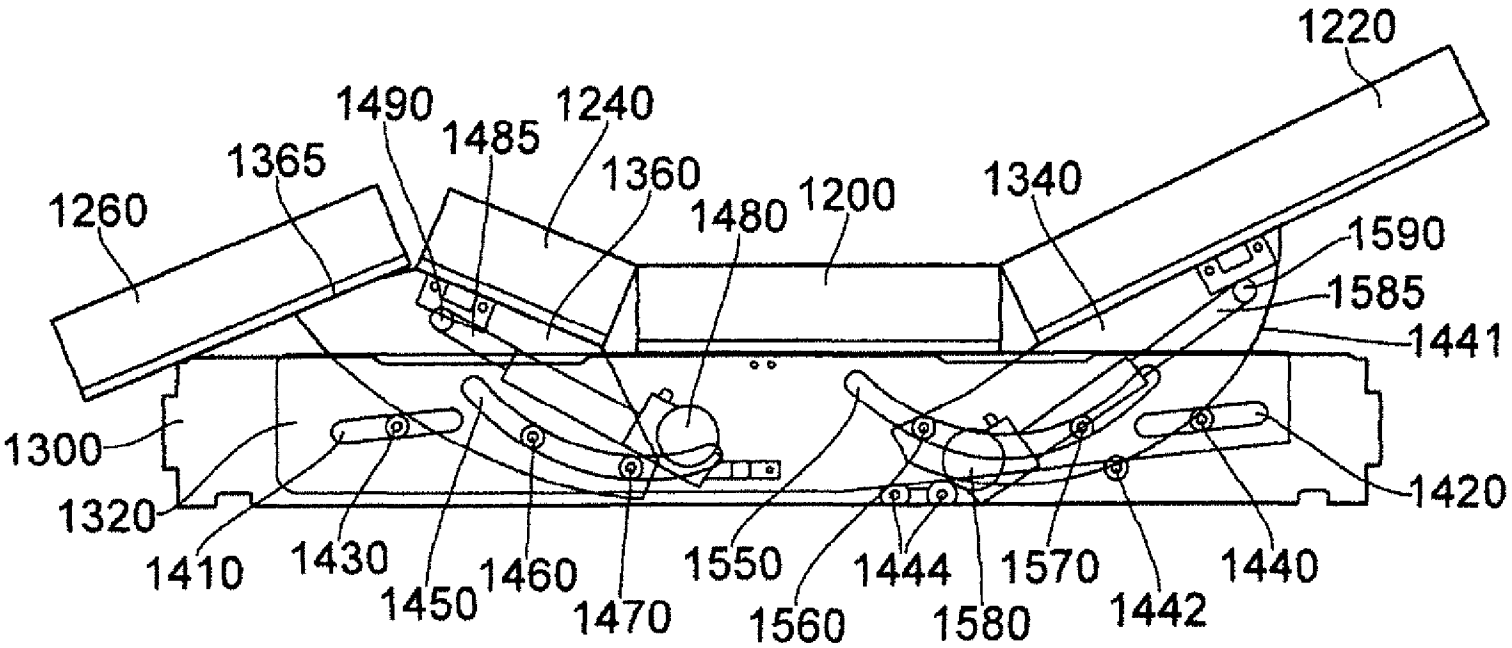
FIG. 8 shows the bed of FIG. 7 having been adjusted into a user semi-recumbent position.
Figure 9:
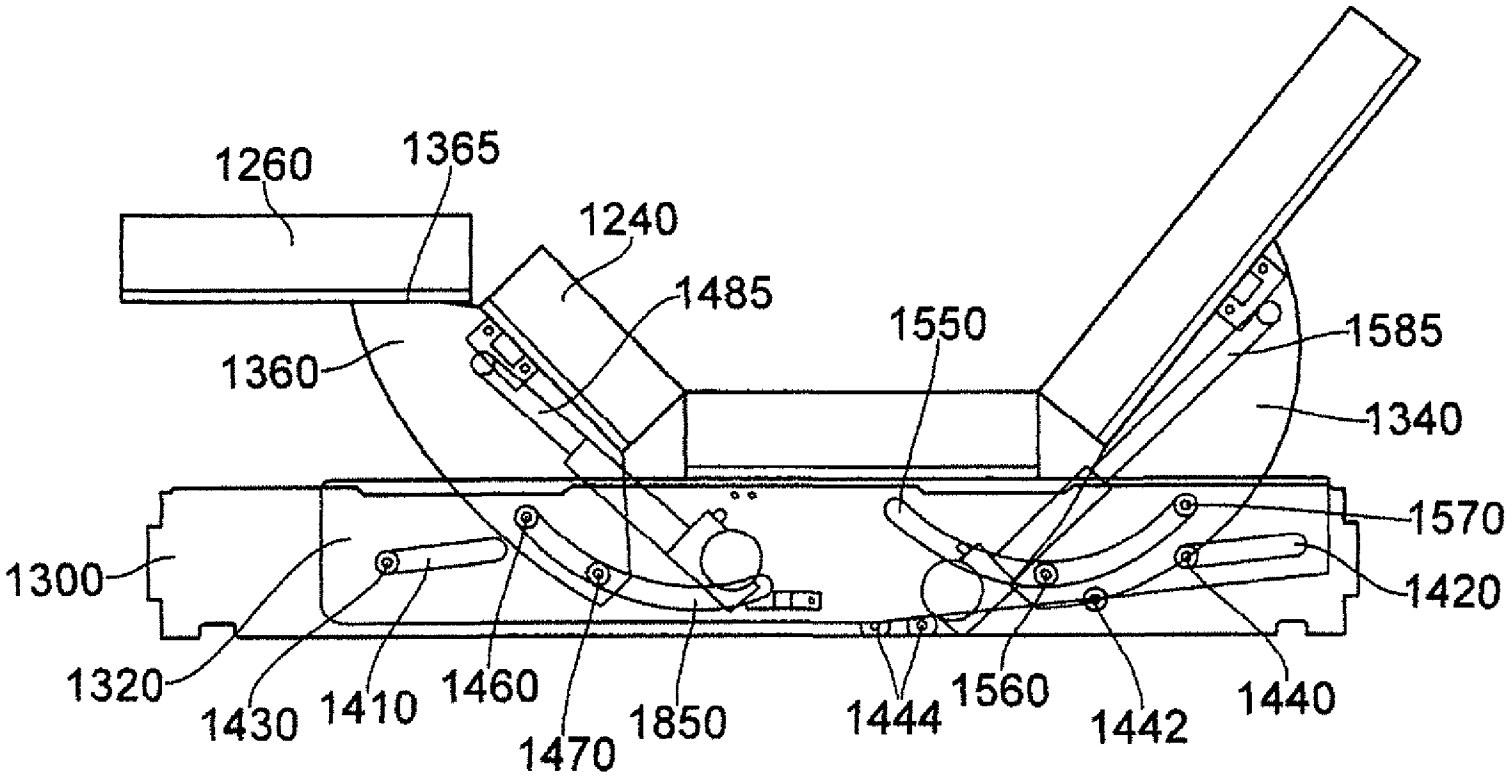
FIG. 9 shows the bed raised into a more upright or user sitting position.

FIG. 7 shows schematically a side view of an adjustable bed according to a second embodiment of the present invention. The bed comprises a fixed intermediate body support portion 1200, back/head support 1220, upper leg support 1240, and lower leg/foot support 1260, all supported by a main frame (base) 1300 and a sub-assembly (intermediate support) 1320 which is moveable relative to the main frame 1300. In the drawings of FIGS. 7 to 9 only one side of the adjustable bed is shown schematically. It will be understood that in the illustrated arrangement the bed will be similarly constructed on both sides, as shown in the embodiments of FIGS. 1 to 6, that is to say symmetrically along a longitudinal central axis of the bed. In the embodiment of FIGS. 7 to 9 the body support sections 1200, 1220, 1240 and 1260 each comprise a support panel on which is mounted a mattress support cushion, which cushions combine to provide a so called "soft edge" mattress foundation. In use a mattress (not shown) sits on top of the support cushions as is well known in the art.

The sub-assembly or intermediate support 1320 has slots 1410, 1420 within which run bearings 1430, 1440 mounted on shafts extending from the main frame of the base to permit the sub-assembly 1320 to move relative to the main frame 300 in a left/right sense as illustrated. Additional bearing 1442 is provided on the main frame for effecting movement of the sub-assembly with respect to the base during movement of the back support 1220 about its pivot axis. The bearing 1442 also provides for slightly elevating the sub-assembly during such movement as will be described below.

A load-bearing member 1340 is attached to the underside of the back support 1220, and a load-bearing member 1360 is attached to the underside of the leg support 1240. The leg support load-bearing member 1360 has an angled surface 365, similar to the angles surface 46 in the first embodiment.

Electrical linear motors 1480, 1580 are connected by pivotal connections 1490, 1590 respectively to the leg support 1240 and back support 1220 for raising these portions of the bed as shown in FIGS. 8 and 9 in order to adjust the position of a person lying on the bed. The leg support load-bearing member 1360 and back support load-bearing member 1340 respectively carry support bearings 1460, 1470 and 1560, 1570 which run in curved slots 1450, and 1550 respectively for supporting at least part of the load supported by the item of furniture. In this respect the bed according to the embodiment of FIGS. 7 to 9 is similar to that of the bed shown in FIGS. 1 to 6.

The same part numbering is used in FIGS. 8 and 9 to show the bed in respective partly raised and fully raised positions. In FIG. 8, the leg support drive motor 1480 has extended a threaded spindle 1485 to tilt the leg support 1240 upwards and clockwise (as illustrated), thus allowing the pivotally connected lower leg and foot support 1260 to move anti-clockwise (as illustrated) until it meets the angled surface 1365 of the leg support load-bearing member 1360. The leg support load-bearing member 1360 has moved with this action to the semi-raised position shown.

Similarly, the back support raising motor 1580 has extended the spindle 1585 to raise the back support upwards and anti-clockwise (as shown). This has the effect of moving the sub-assembly 1320 from left to right as illustrated with the slots 1410, 1420 moving from left to right on the support bearings 1430, 1440 and the sub-assembly 320 being slightly raised on the additional bearings 1442 and 1444.

The angular motion of the load-bearing members 1340, 1360 moves their attached bearings 1460, 1470, 1560, 1570 along the slots 1450, 1550 in the sub-assembly 1320 from the positions illustrated in FIG. 7 to those illustrated in FIG. 8, thus supporting at least part of the load which, in the prior art, would be born by the extension motors and spindles alone.

FIG. 9 shows the corresponding position when the drive motors have fully extended the threaded spindles 1485, 1585 so that the bearings 1460, 1470, 1560, 1570 of the respective load-supporting members 1360, 1340 move within the sub-assembly slots 1450, 1550 from the position shown in FIG. 7 to the final position shown in FIG. 9. The sub-assembly 1320 has accordingly moved further to the right on its support bearings 1430, 1440 in slots 1410, 1420 and has been slightly further raised by the additional bearings 1442. The upper leg support and lower leg/foot support portions 1240, 1260 are retained at the pre-determined angle achieved in FIG. 7 due to the contact of the foot and lower leg support 1260 with the angled surface 1365 of load-bearing member 1360. The leg support 1240 and support 260 are pivotally connected together in known manner.

It is to be understood that the bearing 1442 follows the curvature of the semi-circular guide surface 441 on the underside of the load support member 1340 such that as the load bearing support member 1340 rotates about its pivot axis from the position shown in FIG. 7 to that of FIG. 9, the reaction force generated between the bearing 1442 and the guide surface 1441 causes the sub-assembly 1320 to move relative to the base 1300, which relative movement is determined by engagement of the inclined slots 1420, 1430 with respective bearings 1430, 1440 rotatably fixed on the base 1300.

As can be next seen in the embodiment of FIGS. 7 to 9 the centres of curvature 1451, 1551 of the respective arcuate guide slots 1450, 1550 is co-incident with the adjoining edges at the upper surface of the respective body support portions, 1200 and 1220, and 1200 and 1240. This arrangement reduces the possibility of damaging compression forces being developed at the natural pinch parts along the adjoining edges of the seat portion 1200 with the adjacent body support portions 1220 and 1240 when the adjustable support portions are raised. As can be seen in FIGS. 8 and 9 there is no interference between the respective upper adjoining edges of the supports 1200, 1220 and 1240 when the support members are raised.

FIGS. 10 to 21 show schematically an adjustable bed 200 according to a third embodiment of the present invention. The bed 200 comprises an adjustable back support section 202, a fixed middle/intermediate support section 204, an adjustable upper leg support section 206 and lower leg support section 208.

In FIGS. 10 to 12 and FIGS. 16 and 17 the bed 200 is shown in its lowered configuration with the back support section 202, middle support section 204 and leg support sections 206, 208 lowered where the adjacent support sections lie substantially flat above a base support 210. The support sections 202, 204, 206, 208 comprise respective adjacent flat planar panels 212, 214, 216, 218 which support respective adjacent mattress support cushions or pads 220, 222, 224, 226 which combine to provide a mattress support foundation on which a suitable mattress (not shown) is supported to provide a so called "soft edge" adjustable bed. The bed 200 is a double bed but the present embodiment contemplates beds of many different widths including standard single size beds to much larger doubles.

Figure 11:
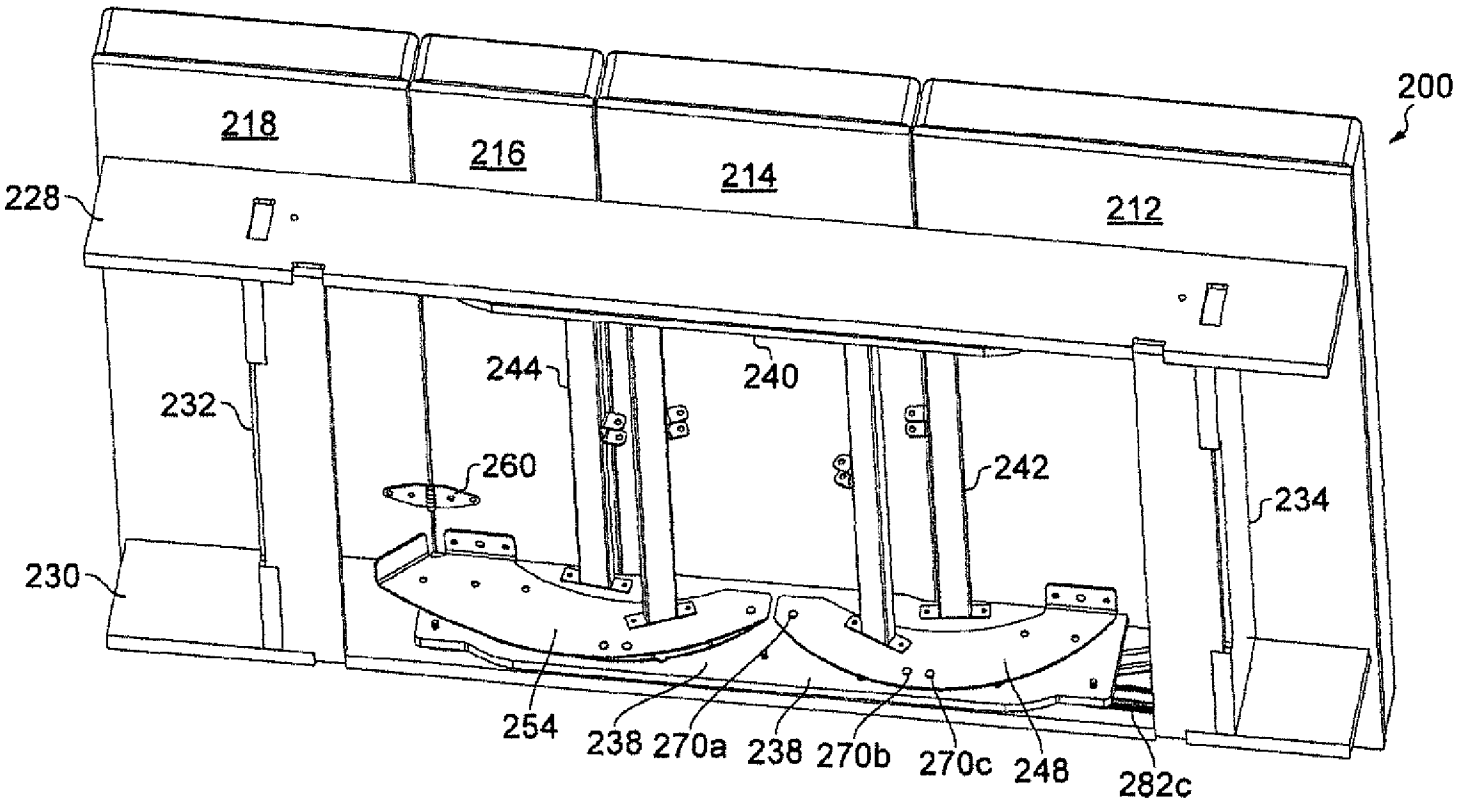
FIG. 11 is a perspective view from below of the underside of the adjustable bed of FIG. 10.

As can best be seen in FIG. 11, the base support 210 comprises a generally rectangular frame constructed by a board type material which may be an engineering plastic, MDF, timber or other fibre type board for example. The base support frame 210 includes a pair of elongate lateral side panels 228, 230 which are joined together near their respective ends by cross member panels 232, 234 to form a rectangular box type structural support frame. The base support frame 210 constitutes the floor standing part of the bed 200 and in this respect the support frame may stand directly on the floor or be provided with castors, feet or the like as is well known in the art.

Figure 12:
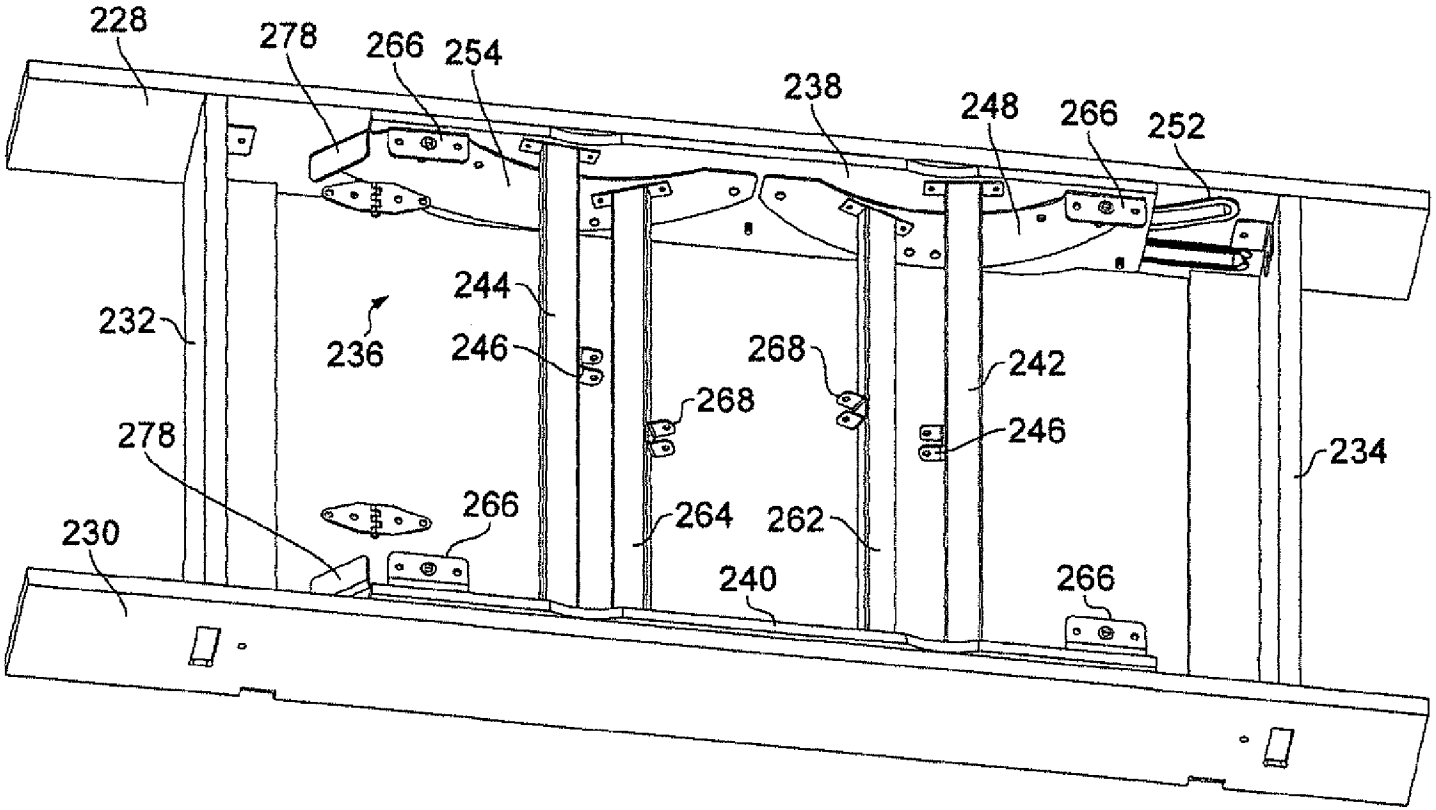
FIG. 12 is a perspective view from above of the adjustable bed of FIG. 10, with various parts omitted for clarity.
Figure 13:
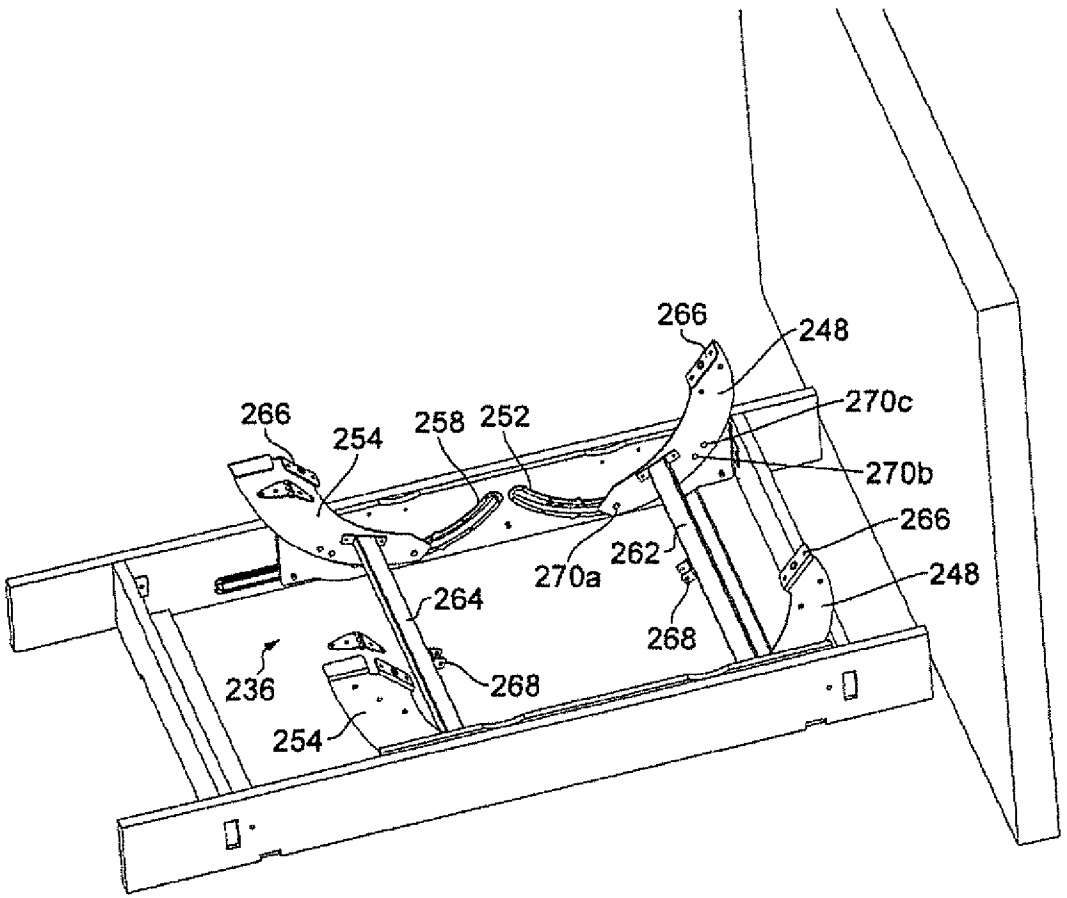
FIG. 13 is a perspective view from above showing the same component parts of the bed of FIG. 10, with the parts positioned in a raised configuration of the bed.

An intermediate support in the form of a movable carriage 236 is mounted within the interior region of the base support frame 210 on the underside of the body support sections 202, 204, 206, 208. The intermediate support 236 can best be seen in the drawings of FIGS. 12 and 13 where the body support panels 212-218 and their associated mattress support cushions 220-226 are omitted from the drawings for clarity. In FIG. 12 the illustrated component parts of the bed are shown positioned with the bed in its normal flat configuration. In FIG. 13 the illustrated parts are shown with the bed positioned in a fully upright configuration. The intermediate support carriage comprises a pair of elongate parallel side panels 238, 240 disposed adjacent the lateral left and right hand side panels 228, 230 of the base support frame. The panels 238, 240 are symmetrically identical such that the mounting arrangement on one side of the bed is the same as the other. The panels are rigidly joined together by a pair of parallel cross members 242, 244 which are spaced apart along the length of the bed. The panels 238, 240 are preferably constructed from a board material such as MDF or an engineering plastic as commonly used in the furniture industry and suitable for CNC machining. The cross-members 242, 244 may be constructed from the same material as the side panels but may also be metal, preferably steel for supporting applied actuator loads to move the various body sections as will be more fully described below. The cross-members 242, 244 are each provided with respective actuator mounting brackets 246 at the mid-point along their length.

The back support panel 212 is pivotally mounted to the intermediate support carriage by a pair of load support members 248 attached to and extending from the underside of the support panel 212. The load support members 248 are spaced apart and located at laterally spaced positions on the panel 212 so that they lie substantially adjacent to the respective side panels 238, 240 of the intermediate support on the internal side thereof such that rolling element bearings 250*a*, 250*b*, 250*c* (FIGS. 14, 15 and 16) rotatably mounted on the sides of the load bearing members 248 locate, and are held captive in, respective arcuate slots 252 in the respective panels 238, 240. The load bearing support members 248 constitute a connecting lever pivotally mounting the back rest support 202 with respect to the intermediate support.

The upper leg support panel 216 is similarly pivotally mounted to the intermediate support carriage by a pair of load support members 254 attached to and extending from the underside of the support panel 216. The load support members 254 are spaced apart and located at laterally spaced positions on the panel 216 so that they lie substantially adjacent to the respective side panels 238, 240 of the intermediate support on the internal side thereof such that rolling element bearings 256*a*, 256*b*, 256*c* (FIGS. 14 and 15) rotatably mounted on the sides of the load bearing members 254 locate, and are held captive in, respective arcuate slots 258 in the respective panels 238, 240.

Figure 10:
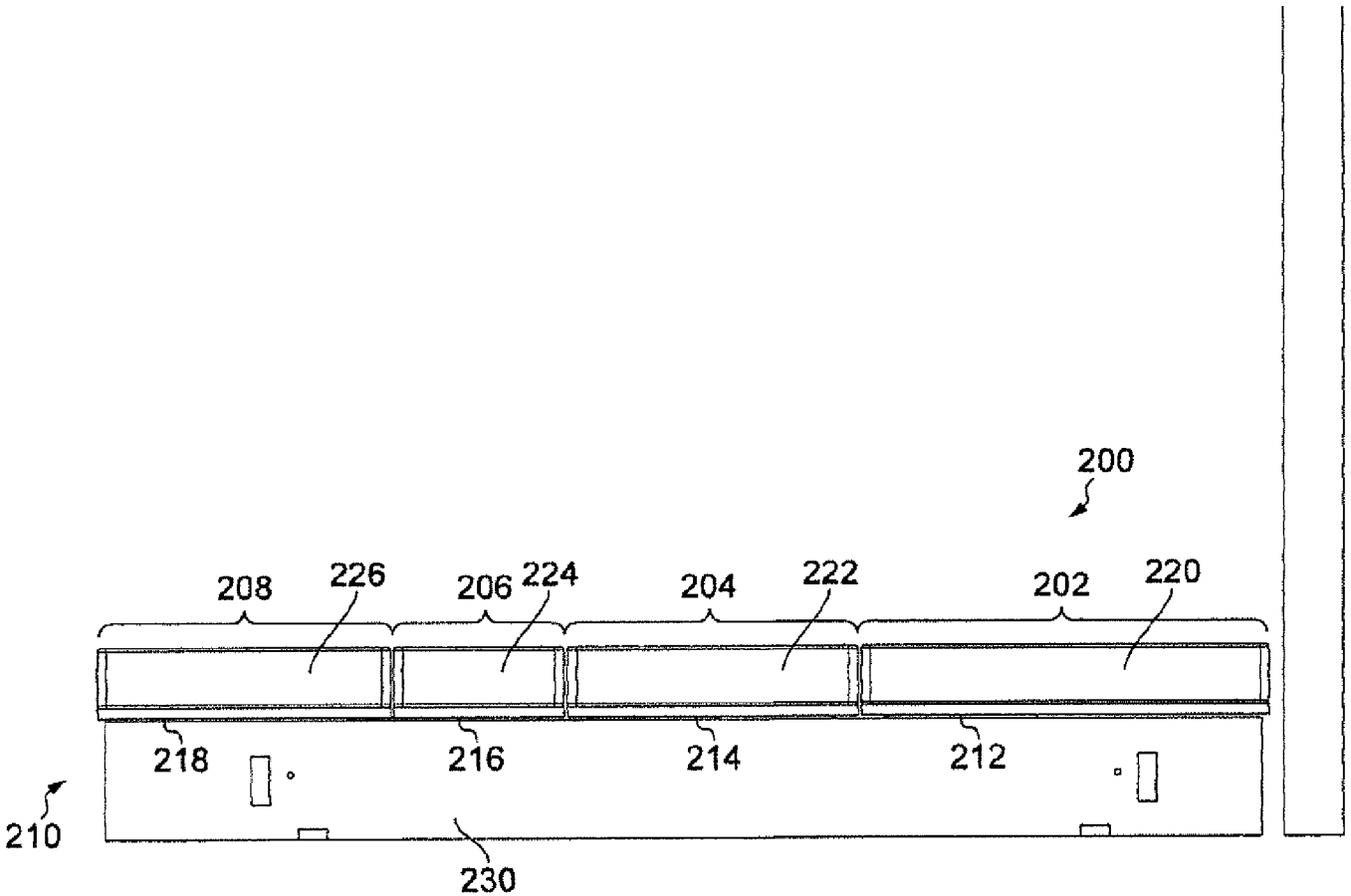
FIG. 10 is a side elevation view of an adjustable bed according to a further embodiment of the present invention.

The mid-section panel 214 is fixed with respect to the intermediate support carriage immediately between the back and upper leg support panels 212, 216 in the lowered configuration of the bed as shown in FIG. 10. The lower leg support panel 218 is pivotally connected to the upper leg support panel 216 along their respective adjoining edges by hinges 260.

The load bearing members 248 and 254 are substantially planar having a crescent shape and are designed such that they lie substantially flush, with a small clearance of a few millimeters or so, with the respective side panels 238, 240 of the intermediate support, within the envelope of the base support carriage in the lowered configuration of the bed as shown in FIGS. 11 and 12, with the panels 212-218 lying substantially flat on or just above the top edge of the base support frame 210. The load bearing support members 248, 254 are each provided with inwardly projecting planar elements 266 which extend perpendicular to the plane of the support members to provide mounting members for engagement with and fixing to the underside of the respective panels 212 and 216.

The load bearing support members 248 are rigidly connected together by means of a cross-member 262, and similarly the load bearing support members 254 are connected together by a cross-member 264. The cross-members 262, 264 are each provided with actuator mounting brackets 268 at a mid-point along their length, each for connection to one end of a respective linear actuator (not shown).

Figure 14:
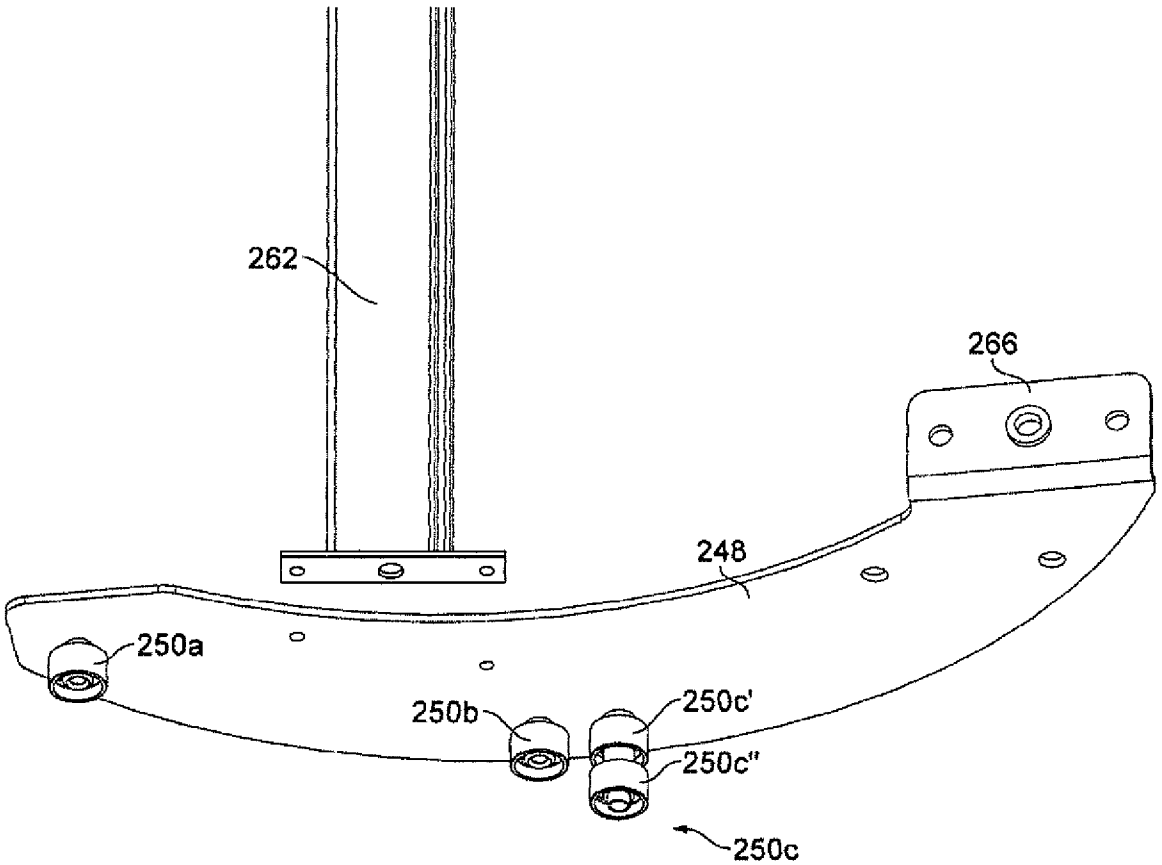
FIG. 14 is a perspective view of component parts of the bed of FIG. 10.
Figure 15:
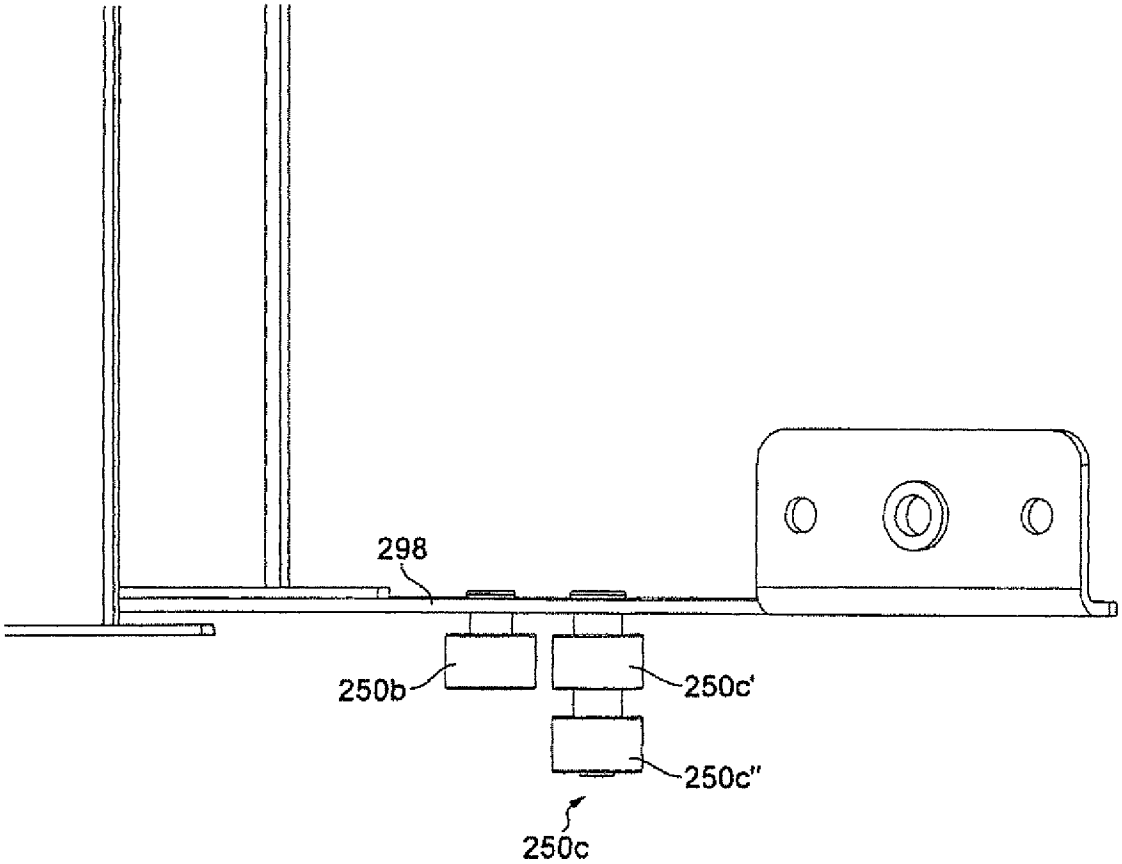
FIG. 15 is a plan view of the parts shown in FIG. 14.

As can best be seen in the drawing of FIG. 14 each load bearing member 248 is provided with rolling element bearings 250*a*, 250*b*, 250*c* located on that side of the support member facing the adjacent side panel of the intermediate support carriage. The bearings 250*a* and 250*b* are of similar construction and comprise a single rolling element bearing mounted on an upstanding pin extending from the surface of the load bearing member. The third bearing 250*c* is slightly different in that it comprises a pair of bearing elements 250*c*' and 250*c*" aligned coaxially on a longer pin. This arrangement is shown further in the plan view of bearing 250*c* in FIG. 15 where the outer most bearing element 250*e*" is located approximately twice the distance from the load bearing support member than the first bearing element 250*e*'. The bearings 250*a*, 250*b* and 250*c* are located at positions indicated 270*a*, 270*b* and 270*c* on the other side of the support member 248 shown in the drawings of FIGS. 11-13.

The bearing arrangement on the load bearing support members 254 is similar to that described above in relation to support members 248, except that is that all three bearings 256*a*, 256*b* and 256*c* are of the single element type as 250*a* and 250*b*, and positioned respectively at positions 272*a*, 272*b* and 272*c*, as indicated on the reverse side of the support members in FIGS. 11-13.

On both sides of the bed bearings 256*a*, 256*b* and 256*c* are located in slot 258 so that the movement of the support members is constrained by the movement of the bearings in those slots 258. This provides the panel 216 and hence the upper leg support section 206 with pivotal movement, with respect to the intermediate support, with the pivot axis defined by the centre of curvature of the slots 258 and with the extent of travel being determined by the length of the slot and the separation of the bearing elements 256*a* and 256*c* in the slot. The range of pivotal movement of the support members 254 is defined by the ends of the slot 258 and the separation of the respective bearings 256*a* and 256*c* by abutment of a respective one of the bearings with a respective end of the slot. The bearings 256*a* and 256*c* may be spaced apart by a maximum distance corresponding to approximately half the length of the curved slot 258.

Similarly bearings 250*a*, 250*b* and 250*c*' are located in slots 252 so that the movement of the support members is constrained by the movement of the bearings in the slots 252. This provides the panel 212 and hence the back support section 202 with pivotal movement, with respect to the intermediate support, with the pivot axis defined by the centre of curvature of the slots 252 and with the extent of travel being determined by the length of the slot and the separation of the bearing elements 250*a* and 250*c*' in the slot. The range of pivotal movement of the support member 248 is defined by the ends of the slot 252 and the separation of the respective bearings 250*a* and 250*c*' by abutment of a respective one of the bearings with a respective end of the slot. The bearings 250*a* and 250*c*' may be spaced apart by a maximum distance corresponding to approximately half the length of the curved slot 252

Figure 16:
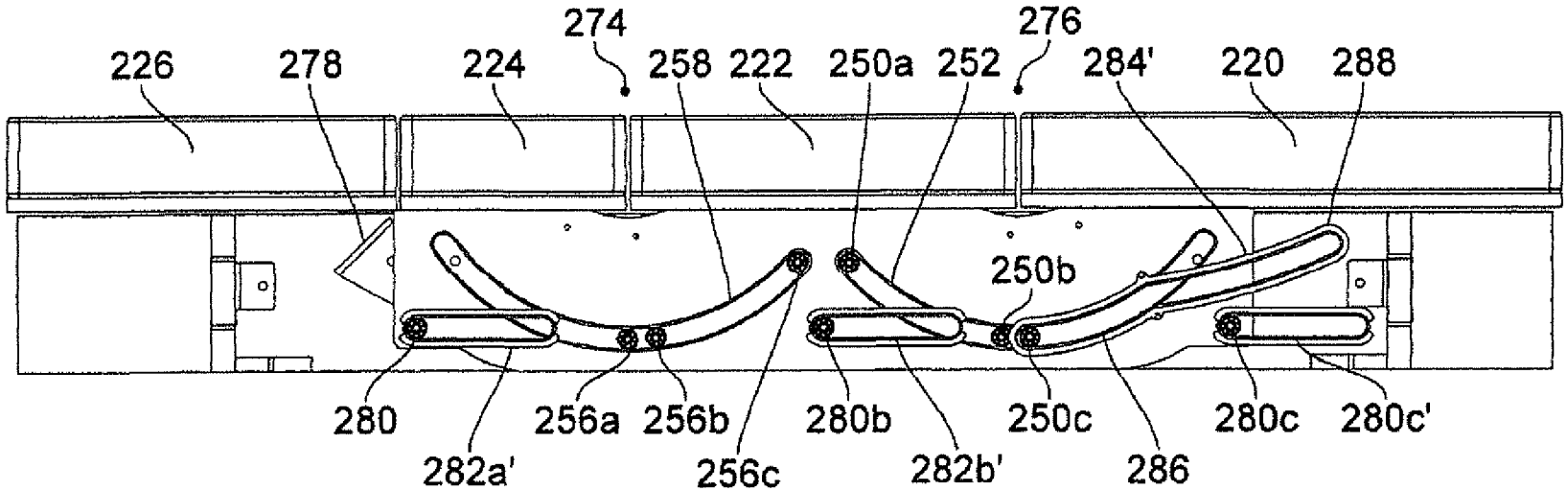
FIG. 16 is a side elevation similar to that of FIG. 10 with an outer panel of the bed omitted to show internal detail.

The position of the slots 252 and 258 can best be seen in the drawing of FIG. 16 where the side panel 228 has been omitted for clarity for the purpose of illustrating the adjustment arrangement of the bed in greater detail. Although only one of the panels 228 of the intermediate support is shown in the side elevation drawing of FIG. 16 it is to be understood that the panels 228, 230 are substantially identical to one another, each having a pair of curved guide slots 252, 258 for accommodating support bearings 250*a-c*' and 256*a-c* as previously described. The first guide slot 250 is provided in the rearward half of the panel 228 and the second slot 258 in the forward half of the panel. The centre of curvature 274 of the first slot 258 is positioned at the adjoining upper edges of the adjacent mattress support cushions 222, 224 so that in use adjustment of the bed between its various positions does not cause compression of the mattress (not shown but located on top of the support cushions in use) in the region of the adjoining edges of the support cushions. Likewise The centre of curvature 276 of the second slot 252 is positioned at the adjoining edges of the adjacent mattress support cushions 220, 222 so that in use adjustment of the bed between its various positions does not cause compression of the cushions or the mattress in the region of these adjoining edges.

The position of the bearing elements 250*a-c* and 256*a-c* is illustrated in the drawing of FIG. 16 when the bed is in its lowered configuration, with the bearing 256*c* at the rear end of the front slot 258 and the bearing 250*a* positioned at the front end of the rear slot 250.

Figure 17:
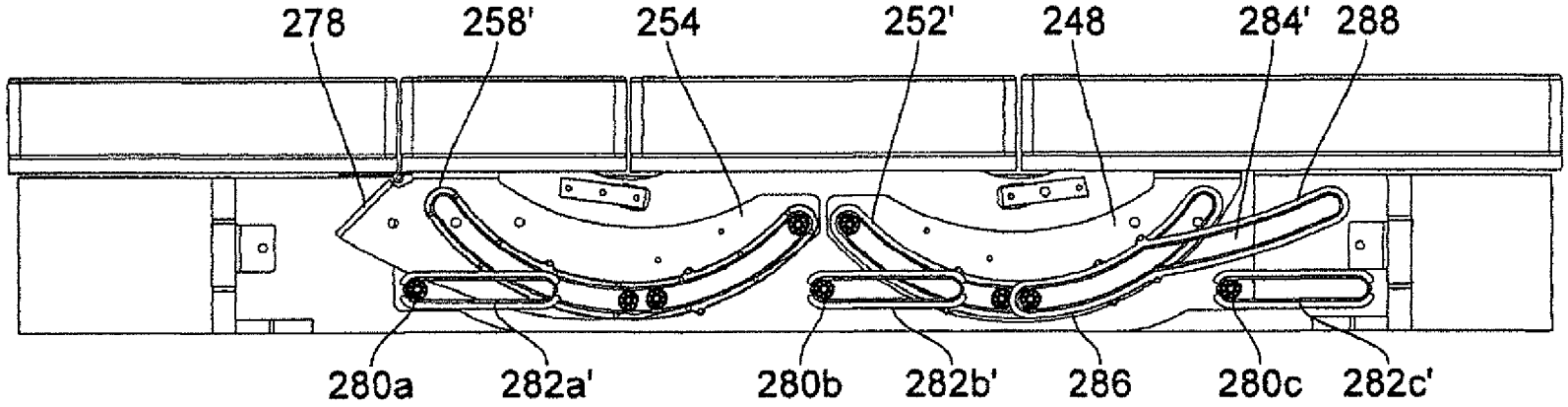
FIG. 17 is a similar view to that of FIG. 31 with a further panel omitted.
Figure 18:
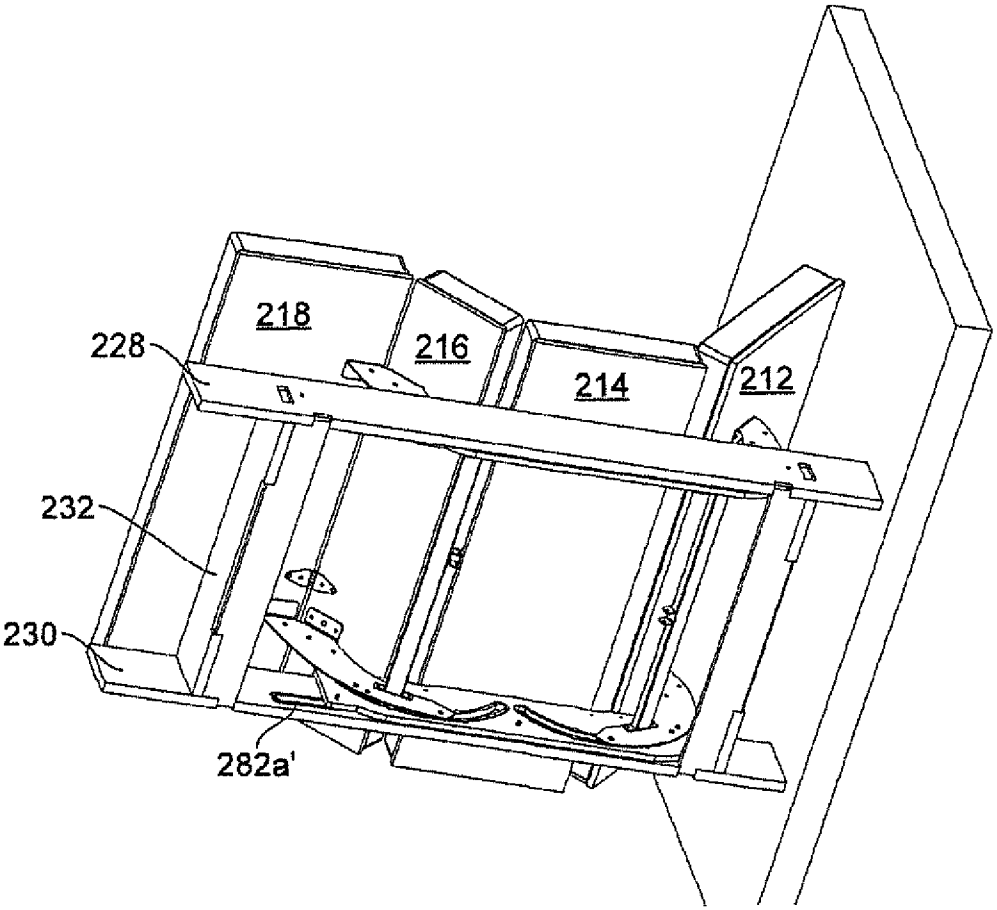
FIG. 18 is a perspective view from below showing the underside of the bed when in a raised position.

The position of the bearing elements 250*a-c* and 256*a-c* is also illustrated in the drawing of FIG. 17 in which the side panel 240 is also removed to show further detail. In this drawing the position of the front and rear slots is indicated by slot inserts 252' and 258' which are illustrated in their in-situ position as if the side panel 240 were present. The inserts 252' and 256' provide a hardwearing bearing surface for the bearing elements 250*a-c*' and 256*a-c* and fit in appropriately sized slots in the respective side panels of the intermediate support carriage and function in a similar way to the slot inserts 32, 38 in previous embodiments. In the drawing of FIG. 17 the relative position of the slots 252 and 258 and the load bearing support members 248, 254 can be seen for the bed in its lowered configuration. The side elevation of FIG. 17 also more clearly illustrates the profile of the load bearing support members 248 and 254, including the angled abutment face 278 at the forward end of the load bearing support members 254, the purpose of which will be described in detail below.

The drawings of FIGS. 16 and 17 also illustrate the manner in which the intermediate support carriage is movably mounted with respect to the base support 210. Each side panel 238, 240 is provided with three rolling element bearings 280*a-c*, positioned at spaced apart locations along the length of the respective panels, mounted on bearing pins upstanding from the surface of the respective panel and projecting towards the adjacent outer panel 228, 230 of the base support in which bearing engagement slots 282*a-c* are provided for receiving respective slot inserts 282*a*'-c. The inserts 282*a*'-c' are shown in their respective in-situ positions in the drawings of FIGS. 16 and 17 although the side panel 240 in which they are mounted has been omitted for the purpose of illustration. The inserts 282*a*'-c' are located in blind slots provided on the inward facing surface of the respective side panels 228, 230. Part of the rear slot insert 282*c*' can be seen in the drawing of FIG. 11 and part of the forward slot insert 282*a*' in the drawing of FIG. 18.

The slots 282*a-c* and corresponding inserts 282*a*'-c' are linear and aligned along the length of the panels 228, 230 to guide the intermediate support carriage in a non-inclined linear parallel direction with respect to the base support during adjustment of the bed between its various positions. The slots and inserts are substantially identical and generally equally spaced along the mid part of the bed. The slots 280*a-c* are blind in that they do not create apertures in the side of the panels 228, 230, but are deep enough to accommodate the respective inserts and rolling element bearings 280*a-c* fixed to the intermediate support carriage. This arrangement constitutes the aforementioned first guide means in this embodiment of the invention.

A fourth slot 284 and insert 284' combination is provided towards the rear of the panels 228, 230 which accommodates the bearing element 250*c*" mounted on the rear load bearing support member 248. This arrangement constitutes the aforementioned second guide means in this embodiment. The fourth slot 284 is curvilinear having first and second curved sections 286, 288. The first section 286 has a curvature that matches that of the slot 252 and is coincident with the rear part of that slot when the bed occupies a position between the fully lowered position and the half raised position of FIG. 19. In this range of relative movement the bearing 250*c*" moves freely in the first section 286 as the back support is raised to the half raised position of FIG. 19, then the curvature and direction of the slot changes abruptly. The second section 288 has a different centre of curvature to the first section and rises more gently along the length of the panel 228, 230 than the first section. This change in curvature generates a reaction force between the bearing element 250*c*" and the second section 288 of the slot, which forces the intermediate support carriage forward relative to the base support along guides 280*a-c* as a turning moment is applied (by one of the actuators or otherwise)n to the back support section of the bed. As the back support section is raised beyond the intermediate position of FIG. 19 the bearing 250*c*" is forced to move along the second section of the slot and the resistance that is generated by the reaction of the bearing element with the upper surface of the slot 288 drives the intermediate section forward with respect to the base support. This resultant motion is similar to the relative motion of the support and intermediate support sections of the chair arrangements of the previous embodiments where the back rest is moved. In the present embodiment similar coordinated movement occurs when the back support section of the bed is moved when it is raised to provide a backrest in the upright configuration of the bed. Thus, the bed described in this embodiment also functions as a zero wall item of furniture. This is particularly advantageous in the context of adjustable beds as it enables the user to retain access to beside furniture etc, as the relative position of the user relative to that furniture does not change when the back rest is raised or lowered, as the movement is compensated by the linear forward or backward movement of the intermediate support carriage on which the body support sections are mounted.

Figure 19:
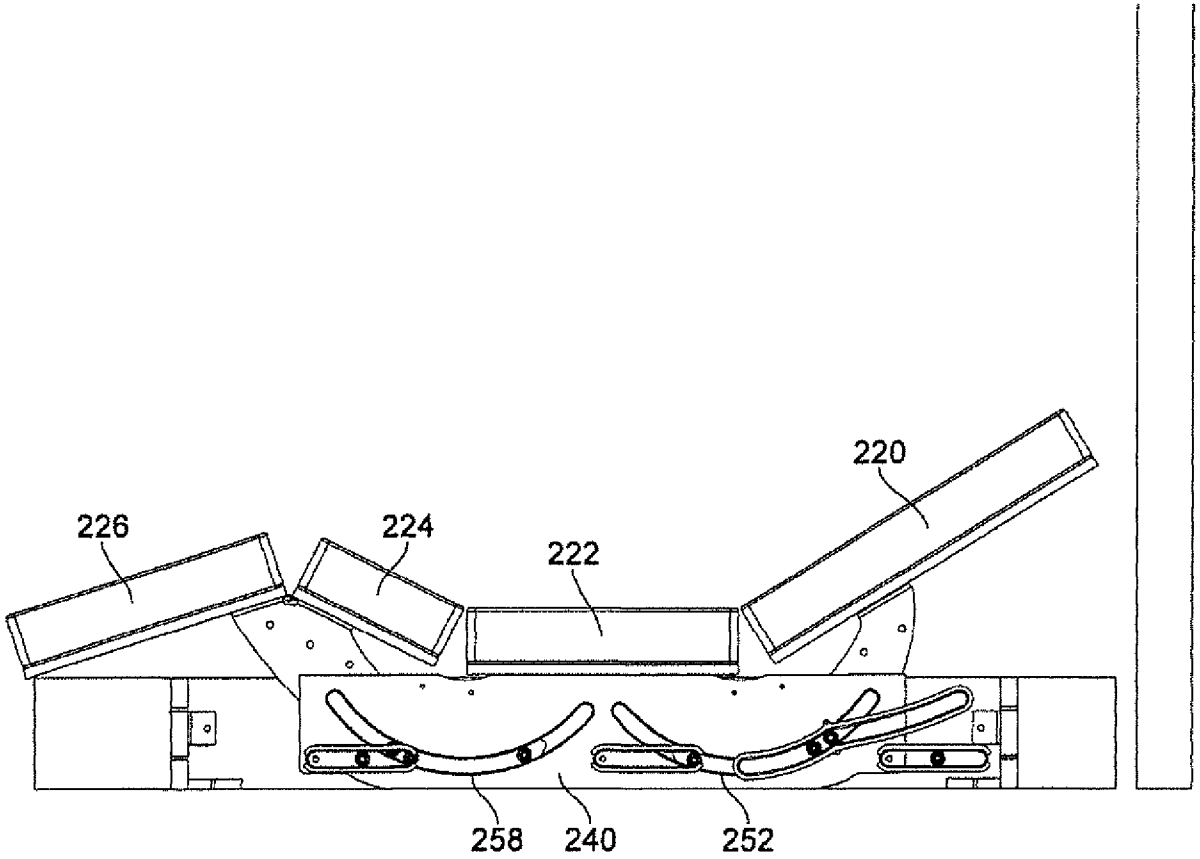
FIG. 19 is a side elevation view similar to that of FIG. 17 with the bed in a part raised position.
Figure 20:
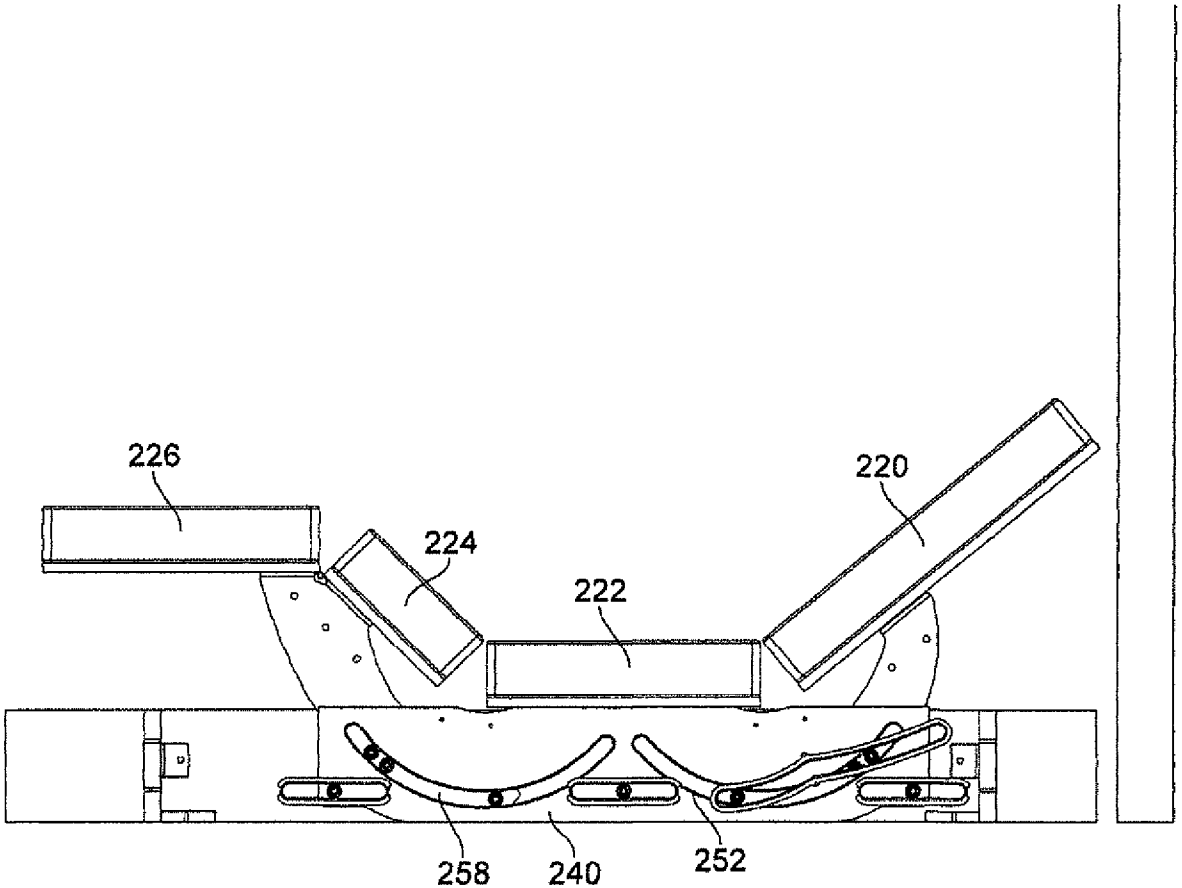
FIG. 20 is a side elevation view similar to that of FIG. 19 with the bed raised further.
Figure 21:
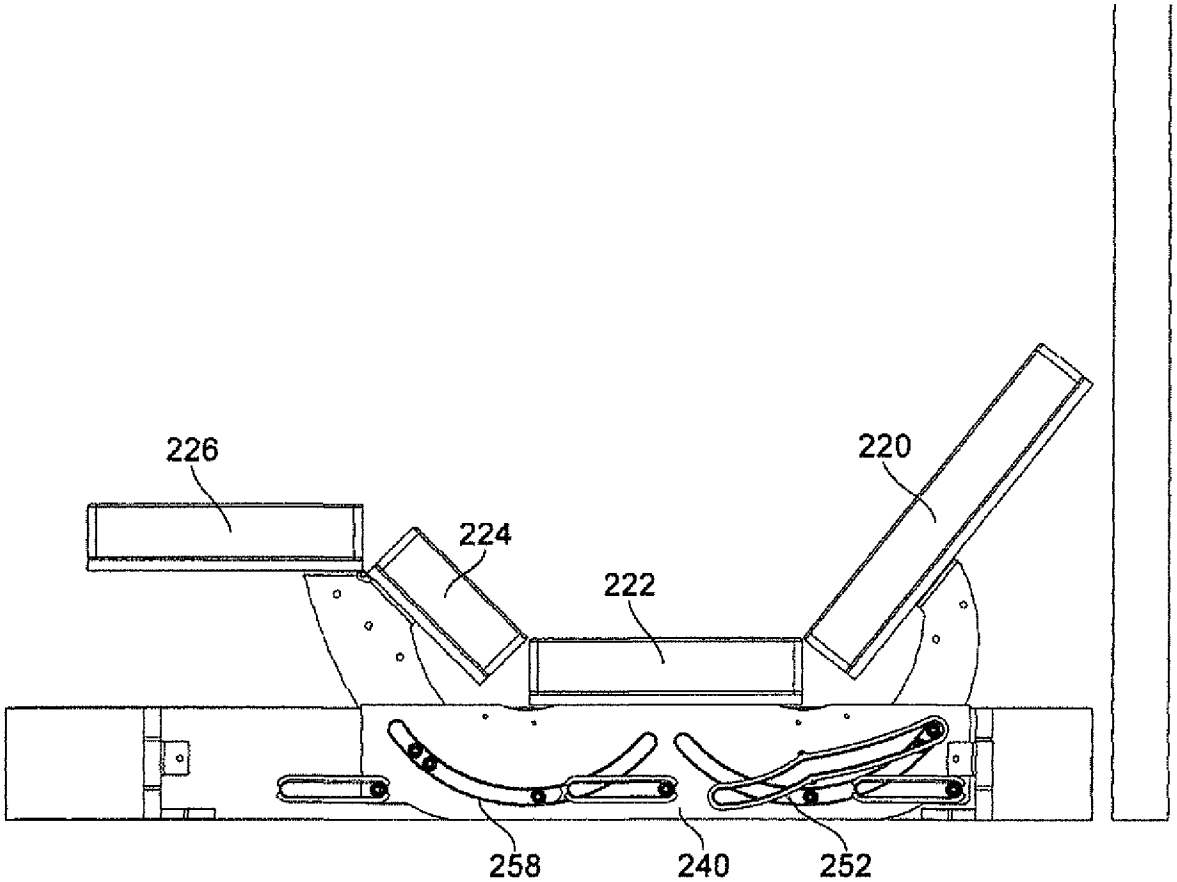
FIG. 21 is a side elevation view similar to FIG. 20 with the bed in its fully raised position.

The relative positions of the various parts of the bed as the configuration of the bed is adjusted from the fully lowered configuration to the fully raised configuration can be seen by following the sequence of drawings of FIG. 17 (fully lowered), FIG. 19 (half raised), FIG. 20 (intermediate between half raised and fully raised) though to FIG. 21 (fully raised). Each drawing presents the same part side view of the bed construction as FIG. 17 and illustrates the relative positions of the bearings in the respective slots as the bed is moved from one configuration to another.

In the illustrated embodiment movement of the bed through the various positions shown is effected by means of two linear electrical actuators of the type commonly used in adjustable furniture arrangements, including a first actuator (not shown) connected between bracket 246 on cross-member 244 and bracket 268 on cross-member 262 for moving the back support section 202, and a second linear actuator (not shown) connected between bracket 246 on cross-member 242 and bracket 268 on cross-member 264 for moving the leg support sections 206. It will be understood by those skilled in the art that the relative position of the linear actuator jacks on the underside of the bed 200 is particularly advantageous, first because the force vector applied by the actuators actually follows the movement of the load bearing support panels as they move, since both ends of the actuator are pivotally connected to the respective aforementioned brackets, and second because the force vector is always offset, by a significant distance, to the respective pivot axis, 274, 276 about which the turning moment generated by the actuator is applied, thus providing the powered arrangement with considerable mechanical advantage.

As can best be seen by comparison of the drawings of FIGS. 17 and 19 the angled abutment surface 278 at the end of each load bearing support member 254 serves to limit the extent of pivotal movement at the hinge connection 260 between the panels 216 and 218. When the support members begin to rotate about their pivot axis at 274 both sections 208 and 206 begin to lift but hinge apart until the position of FIG. 19 is reached when the abutment surface 278 engages the underside of the panel 218. This provides a useful "knee break" function where the users' lower legs are not raised until a comfortable relative position of the upper and lower part of the limbs is first achieved.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. An adjustable bed comprising:

a plurality of body-support portions mounted on or in relation to a moveable intermediate support carriage, said body-support portions including an adjustable back section, a fixed middle section adjacent to the back section, an adjustable upper leg section adjacent to the middle section and an adjustable lower leg/foot section pivotally connected with respect to the upper leg section, the said body-support portions being mounted with respect to the intermediate support carriage to allow angular adjustment of their relative positions to alter the configuration of the bed; the intermediate support carriage being movably mounted on or in relation to a fixed base for translational movement with respect thereto in response to angular adjustment of the said back section; wherein at least one load-bearing member projects from at least one of the back section and upper leg section, the said load-bearing member being supported by bearing means arranged to run on a curved support such that at least one of the back section and the upper leg is pivotally mounted with respect to the said intermediate support carriage about a respective pivot axis defined by the centre of curvature of the respective curved support.

2. An adjustable bed as claimed in claim 1, wherein the said intermediate support carriage comprises a pair of elongate parallel side panels.

3. An adjustable bed as claimed in claim 2, wherein the said elongate parallel side panels are joined together.

4. An adjustable bed as claimed in claim 2, wherein said intermediate support comprises a sub-assembly moveable with in a frame of the said base.

5. An adjustable bed as claimed in claim 4, wherein said intermediate support is movably mounted with respect to said base by guide means.

6. An adjustable bed as claimed in claim 5, wherein said guide means comprises bearing means carried by the said intermediate support carriage and a guide provided by a slot formed in said base.

7. An adjustable bed as claimed in claim 6, wherein said guide is linear.

8. An adjustable bed as claimed in claim 1 wherein the said base comprises a rectangular support frame.

9. An adjustable bed as claimed in claim 1 wherein the bearing means is carried by the said load bearing member and the curved support is provided on or in the intermediate support carriage.

10. An adjustable bed as claimed in claim 1, wherein the bearing means is carried on the base and runs in a track in or on the load bearing member.

11. An adjustable bed as claimed in claim 1, wherein at least one pair of said load-bearing members project from the or both movable back and upper leg sections(s), in which pair the load-bearing members are spaced apart and disposed towards the respective sides of the intermediate support carriage.

12. An adjustable bed as claimed in claim 11, wherein the said pair of load bearing members lie substantially parallel with respective lateral side panels of the said intermediate support carriage.

13. An adjustable bed as claimed in claim 1, wherein base comprises a pair of elongate lateral sides and which lie substantially parallel and adjacent to respective lateral side panels of the said intermediate support carriage.

14. An adjustable bed as claimed in claim 1, wherein the said intermediate support carriage comprises a movable sub-assembly mounted within a support frame of said base.

15. An adjustable bed as claimed in claim 1, wherein the pivot axis of each movable body-support portion is positioned above the said base in a plane offset from the top edge thereof.

16. An adjustable bed as claimed in claim 15, wherein the said pivot axis is positioned in a plane offset from the said base by an amount substantially corresponding to the thickness of the body support portions such that the said offset plane is substantially coincident with an upper support surface of the said body support portions when in a flat horizontal position.

17. An adjustable bed as claimed in claim 16 wherein the or each pivot axis is substantially coincident with the adjacent upper edges of respective adjacent body support portions.

18. An adjustable bed as claimed in claim 11, wherein said pair of load bearing members are connected together by a respective cross-member extending on the underside of the respective body-support portion.

19. An adjustable bed according to claim 1, wherein the load-bearing member comprises at least one substantially semi-circular planar element or part thereof on the underside of the body-support portion.

20. An adjustable bed as claimed in claim 1, further comprising actuator means for angularly moving one or more of the body-support portions to effect the said angular adjustment.

21. An adjustable bed as claimed in claim 20, wherein said actuator means comprising at least one linear actuator positioned on the underside of the bed for moving a respective body-support portion about its pivot axis, said actuator having a first end pivotally mounted with respect to the said intermediate support carriage and a second end pivotally mounted with respect to a respective load bearing member, said linear actuator being disposed substantially horizontally and enclosed within the base through its range of movement.

22. An adjustable bed as claimed in claim 21, said actuator being extendable in a forward direction to raise a respective body-support portion and retractable in the reverse direction to lower the said body support portion.

23. An adjustable bed as claimed in claim 1, wherein the lower leg and foot support is arranged to pivot apart from the upper leg support during angular adjustment of the upper leg support, and further comprising a stop that limits the pivotal movement of the foot support at a predetermined angle relative to the leg support.

24. An adjustable bed as claimed in claim 23, wherein the said stop is provided on the load-bearing member projecting from the upper leg support.

* * * * *